US008374537B2

(12) United States Patent
Hatakeyama et al.

(10) Patent No.: US 8,374,537 B2
(45) Date of Patent: Feb. 12, 2013

(54) IMAGE FORMING APPARATUS, PROTECTANT APPLICATOR AND PROCESS CARTRIDGE

(75) Inventors: Kumiko Hatakeyama, Kanagawa-ken (JP); Toshiyuki Kabata, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 475 days.

(21) Appl. No.: 12/396,987

(22) Filed: Mar. 3, 2009

(65) Prior Publication Data

US 2009/0232541 A1 Sep. 17, 2009

(30) Foreign Application Priority Data

Mar. 13, 2008 (JP) ..... 2008-064729
Oct. 1, 2008 (JP) ..... 2008-256853

(51) Int. Cl.
*G03G 21/00* (2006.01)

(52) U.S. Cl. ..... 399/346

(58) Field of Classification Search ..... 399/26, 399/159

See application file for complete search history.

(56) References Cited

U.S. PATENT DOCUMENTS

| | | | | |
|---|---|---|---|---|
| 6,060,205 | A * | 5/2000 | Takeichi et al. | 430/126.2 |
| 6,501,925 | B2 * | 12/2002 | Yamamoto et al. | 399/116 |
| 7,153,621 | B2 * | 12/2006 | Kojima et al. | 430/97 |
| 7,209,699 | B2 | 4/2007 | Yamaguchi et al. | |
| 7,315,711 | B2 | 1/2008 | Ariizumi et al. | |
| 7,505,728 | B2 | 3/2009 | Yamaguchi et al. | |
| 7,542,712 | B2 * | 6/2009 | Tanaka et al. | 399/346 |
| 7,603,071 | B2 * | 10/2009 | Sugiura et al. | 399/346 |
| 7,691,791 | B2 * | 4/2010 | Usami | 508/107 |
| 2005/0169668 | A1 | 8/2005 | Koichi et al. | |
| 2008/0089726 | A1 | 4/2008 | Hatakeyama et al. | |
| 2008/0226365 | A1 | 9/2008 | Hatakeyama et al. | |
| 2008/0253801 | A1 | 10/2008 | Hatakeyama et al. | |
| 2009/0003853 | A1 | 1/2009 | Hatakeyama et al. | |
| 2009/0176669 | A1 | 7/2009 | Sugiura et al. | |
| 2010/0150627 | A1 | 6/2010 | Usami | |

FOREIGN PATENT DOCUMENTS

| | | |
|---|---|---|
| JP | 2597515 | 5/1999 |
| JP | 2004-198662 | 7/2004 |
| JP | 2005-4051 | 1/2005 |
| JP | 2005-17469 | 1/2005 |

(Continued)

OTHER PUBLICATIONS

Japanese official action dated Mar. 13, 2012 in a corresponding Japanese patent application.

*Primary Examiner* — Walter L Lindsay, Jr.
*Assistant Examiner* — Frederick Wenderoth
(74) *Attorney, Agent, or Firm* — Cooper & Dunham LLP

(57) ABSTRACT

An image forming apparatus, including an image bearer; and a protectant applicator applying a protectant including zinc stearate and zinc palmitate to the surface thereof, wherein an average amount of the protectant adhering thereto is from 0.4 to 2.0 μg/cm$^2$ after 500 images are produced, and wherein the following relationships are satisfied:

$$X=Sb/Sa$$

wherein X represents an index of the amount of the protectant adhering at an arbitrary point thereon; Sa represents a peak area in a wavenumber domain of from 1,765 to 1,786 cm$^{-1}$ in an infrared absorption spectrum; and Sb represents a peak area in a wavenumber domain of from 1,533 to 1,547 cm$^{-1}$, and $$\Delta Xi/Xave<0.3$$

wherein Xi represent the indices X at n-pieces of the arbitrary points in an image forming area thereof along its longitudinal direction; Xave represents an average of the n-pieces of Xi; and ΔXi represents a variation of Xi.

14 Claims, 12 Drawing Sheets

FOREIGN PATENT DOCUMENTS

| | | |
|---|---|---|
| JP | 2005-115197 | 4/2005 |
| JP | 2005-249901 | 9/2005 |
| JP | 2006-113499 | 4/2006 |
| JP | 2006-350240 | 12/2006 |
| JP | 2007-65100 | 3/2007 |
| JP | 2007-145993 | 6/2007 |

* cited by examiner

EDGE HAVING AN ANGLE OF 90°

EDGE HAVING AN ANGLE NOT LESS THAN 90°
(OBTUSE ANGLE)

IMAGE FORMING APPARATUS, PROTECTANT APPLICATOR AND PROCESS CARTRIDGE

BACKGROUND

1. Technical Field

This disclosure relates to an image forming apparatus such as copiers, printers, facsimiles or their complex machines, and more particularly to an image forming apparatus equipped with a protectant applicator applying a protectant to an image bearer to protect the image bearer from mechanical stress such as friction with a cleaning blade and from electrical stress when charged. In addition, this disclosure relates to the protectant applicator and a process cartridge or use in the image forming apparatus.

2. Description of Related Art

In an electrophotographic image forming apparatus, an image bearer such as a photoconductive photoreceptors is subjected to a charging process, an irradiating process, a developing process and transferring process to form an image. Discharge products produced in the charging process, remaining on the surface of the photoreceptor and residual toners or toner components remaining thereon after the transferring process are removed in a cleaning process.

Conventional cleaning methods use an inexpensive and simple cleaning blade formed of a rubber or urethane, having good clean ability. However, since the cleaning blade is pressed to the surface of a photoreceptor to remove residues thereon, a stress due to friction between the surface of a photoreceptor and the cleaning blade is large and the cleaning blade and the photoreceptor, particularly an organic photoreceptor, are abraded, resulting in shorter lives thereof.

In addition, a toner used for forming images is having a smaller particle diameter to produce higher quality images. The smaller the particle diameter, the more the toner scrapes through a cleaning blade. Particularly when the cleaning blade has insufficient dimensional accuracy, assemble accuracy or partially oscillates, the toner scrapes through the blade more, resulting in production of poor quality images.

So as to extend the life of an organic photoreceptor to produce high quality images for long periods, deterioration of members such as a cleaning blade due to abrasion needs to be reduced to improve clean ability thereof.

Practically, a lubricant is applied to the surface of a photoreceptor with a cleaning blade to form a film of the lubricant on the surface of the photoreceptor. The lubricant applied to the surface of a photoreceptor reduces abrasion of the photoreceptor due to friction between the cleaning blade and the photoreceptor and deterioration thereof due to discharge energy when charged. In addition, the lubricant increases the lubricity of the surface of a photoreceptor, and reduces partial oscillation of the cleaning blade and the number of toner scraping through the blade. However, since the insufficient lubricant does not exert sufficient effect of lubricity and surface protectivity against the abrasion of a photoreceptor, deterioration thereof when charged with an AC voltage and scraping through the blade of a toner, an image forming apparatus in which an amount of a lubricant applied to the blade is specified is disclosed.

For example, Japanese published unexamined applications Nos. 2005-17469, 2005-249901, 2005-004051 and 2004-298662 disclose an image forming apparatus in which an amount of zinc stearate applied to the surface of a photoreceptor is specified with a ratio of a zinc element to total elements detected by a XPS (X-ray photoelectron spectrometer) analysis on the surface of the photoreceptor. XPS detects all elements except for hydrogen on the surface of a sample. When the surface of an organic photoreceptor coated with zinc stearate ($C_{36}H_{70}O_4Zn$) by XPS, as the coverage of the zinc stearate increases, the element ratio the organic photoreceptor has closes to that of the zinc stearate. When the coverage of the zinc stearate becomes 100%, the element ratio theoretically coincides with that of the zinc stearate and the detected amount of zinc is saturated. Namely, when the zinc stearate covers the whole surface of a photoreceptor, from the element ratio except for hydrogen in a molecule of the zinc stearate, the zinc element ratio is theoretically 2.44% to that of all the elements detected by XPS.

Japanese published unexamined application No. 2004-298662 discloses specifying an applied amount of the protectant by XRF (X-ray Fluorescence) to produce high quality images for long periods. However, depending on the way of using 3 the image forming apparatus, images having parts having uneven image density or abnormality are frequently produced.

Because of these reasons, a need exists for an image forming apparatus capable of well providing and applying a protectant to its image bearer to prevent production of abnormal images and produce high quality images for long periods.

BRIEF SUMMARY

In an aspect of this disclosure, there is provided an image forming apparatus capable of well providing and applying a protectant to its image bearer to prevent production of abnormal images and produce high quality images for long periods.

In another aspect, there is provided a protectant applicator capable of well providing and applying a protectant to an image bearer of an image forming apparatus.

In another aspect, there is provided a process cartridge including the protectant applicator.

In another aspect, there is provided an image forming apparatus, comprising:

an image bearer configured to have a resin layer comprising a carbonate bond on its surface;

an image former configured to form a toner image on the image bearer;

a transferor configured to transfer the toner image onto a receiving material; and a protectant applicator configured to apply a protectant comprising zinc stearate and zinc palmitate to the surface of the image bearer, wherein an average amount of the protectant adhering to the image bearer is from 0.4 to 2.0 $\mu g/cm^2$ after 500 images are produced, and wherein the following relationships are satisfied:

$$X=Sb/Sa$$

wherein X represents an index of the amount of the protectant adhering at an arbitrary point i on the surface of the image bearer; Sa represents a peak area in a wave number domain of from 1,765 to 1,786 $cm^{-1}$ based on a wave number domain of from 1,751 to 1,801 $cm^{-1}$ in an infrared absorption spectrum (IR spectrum) measured by attenuated total reflection (ATR) method using a Ge prism as an ATR prism and an IR incidence angle of 45° at the arbitrary point i on the surface of the image bearer; and Sb represents a peak area in a wave number domain of from 1,533 to 1,547 $cm^{-1}$ based on a wave number domain of from 1,483 to 1,589 $cm^{-1}$ therein, and $$\Delta Xi/X\text{ave}<0.3$$

wherein Xi represent the indices X at n-pieces (1 to n) of the arbitrary points i in an image forming area of the image bearer along its longitudinal direction; Xave represents an average of the n-pieces of Xi; and ΔXi|Xi−Xave| represents a variation of Xi.

The aforementioned and other aspects, features and advantages will become apparent upon consideration of the following description of the preferred embodiments of the present invention taken in conjunction with the accompanying drawings.

DESCRIPTION OF THE PREFERRED EMBODIMENTS

Figure 1:
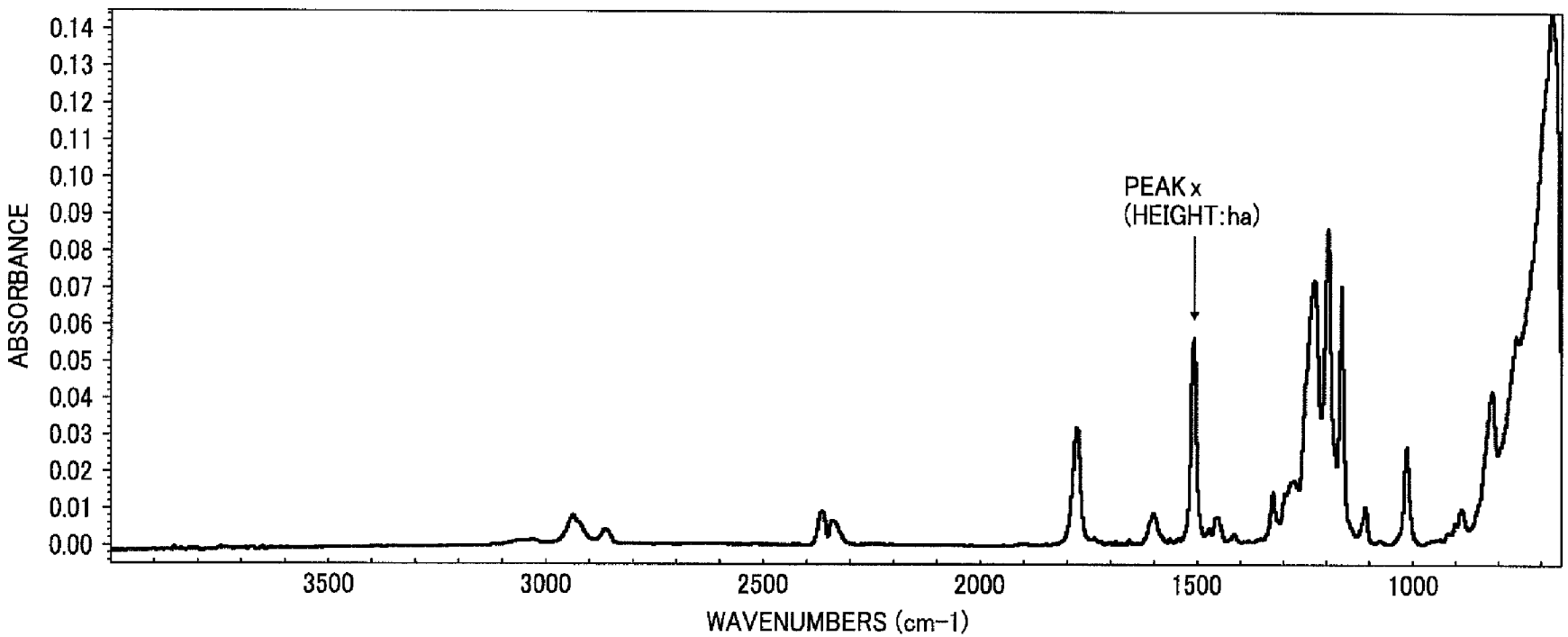
FIG. 1 is an IR spectrum A of a photoreceptor before applied with a protectant.

Generally, the present invention provides an image forming apparatus capable of well providing and applying a protectant to its image bearer to prevent production of abnormal images and produce high quality images for long periods.

More particularly, the present invention relates to an image forming apparatus, comprising:

an image bearer configured to have a resin layer comprising a carbonate bond on its surface;

an image former configured to form a toner image on the image bearer;

a transferor configured to transfer the toner image onto a receiving material; and a protectant applicator configured to apply a protectant comprising zinc stearate and zinc palmitate to the surface of the image bearer, wherein an average amount of the protectant adhering to the image bearer is from 0.4 to 2.0 μg/cm$^2$ after 500 images are produced, and wherein the following relationships are satisfied:

$$X=Sb/Sa$$

wherein X represents an index of the amount of the protectant adhering at an arbitrary point i on the surface of the image bearer; Sa represents a peak area in a wave number domain of from 1,765 to 1,786 cm$^{-1}$ based on a wave number domain of from 1,751 to 1,801 cm$^{-1}$ in an infrared absorption spectrum (IR spectrum) measured by attenuated total reflection (ATR) method using a Ge prism as an ATR prism and an IR incidence angle of 45° at the arbitrary point i on the surface of the image bearer; and Sb represents a peak area in a wave number domain of from 1,533 to 1,547 cm$^{-1}$ based on a wave number domain of from 1,483 to 1,589 cm$^{-1}$ therein, and $$\Delta Xi/Xave<0.3$$

wherein Xi represent the indices X at n-pieces (1 to n) of the arbitrary points i in an image forming area of the image bearer along its longitudinal direction; Xave represents an average of the n-pieces of Xi; and ΔXi|Xi−Xave| represents a variation of Xi.

The present inventors observed the surface of an image bearer (a photoreceptor) with a scanning electron microscope (SEM) to see if amounts of a protectant are different at a site producing abnormal images and at a site not producing them on the image bearer. They could observe that the protectant adhered to the photoreceptor, but could not estimate the amount thereof to identify the cause of abnormal images.

Next, the present inventors further observed the site producing abnormal images on the photoreceptor with a SEM to find that toner components adhere thereto and the image resolution deteriorates when the image area is small, and that the photoreceptor is partially abraded and it is likely that abnormal images are produced when the image area is large. Since abnormal images depend on the images produced, an amount of the protectant adhering to the surface of a photoreceptor was thought to also depend on the images produced and a trial if the amount can be specified per site was made.

Methods of measuring an amount of a protectant including a metal such as a metallic soap typified by zinc stearate and adhering to the surface of a photoreceptor include methods of measuring a concentration of a metallic element in a unit area of the photoreceptor by fluorescent X-ray analysis (XRF) or inductively-coupled plasma (ICP) emission spectral analysis. The ICP emission spectral analysis has good reproducibility, and actually high-quality images can be produced when if zinc stearate has a concentration of from 0.4 to 2.0 μg/cm$^2$ when measured thereby. However, as mentioned above, abnormal images are occasionally produced depending on the images, particularly when images partially having an area of high image density and an area of low image density are produced much.

An analysis sample needs to have a wide area to measure the amount of a metallic soap very thinly coated on the surface of a photoreceptor and cannot be recycled because it is dissolved in a solution. Therefore, it was very difficult to detect variations of the amounts of the metallic soap at segmentalized sites on the surface of the photoreceptor. Then, a trial to use ATR method using Fourier transform infrared spectrophotometer (FT-IR) was made to analyze an amount of a protectant adhering thereto in a narrow area. This is because the ATR method can analyze an organic material at a spot diameter of from a few μm to a few mm.

An IR spectrum obtained by Fourier transform infrared spectrophotometer (FT-IR) shows how the intensity distribution against wavelength of an infrared light varies according to samples, and is typically shown as a curve on a diagram having a horizontal scale of an inverse wave number (cm$^{-1}$) and a vertical scale of transmission (T) or absorbance (A). The transmission is a ratio of an energy having transmitted through the sample to an energy having come therein, and the absorbance is represented by common logarithm of the transmission. It is well known that the absorbance is proportional to a concentration of a sample (Lambert-Beer rule), and the Ir spectrum is typically used to determine the quantity. The peak intensity is preferably an absorbance having good quantitative performance not a transmission. IR spectrum measurers are broadly classified into distributed infrared spectrophotometers and Fourier transform infrared spectrophotometers. The Fourier transform infrared spectrophotometer (FT-IR) is mostly used at present because of having high time efficiency, light quantity availability, wave number resolution and wave number accuracy. The measurement methods include various accessories besides typical transmission methods, and they can be selected according to the formation of a sample and information desired. The ATR (Attenuated Total Reflection) method is considerably used as a FT-IR measurement accessory recently because a sample hardly needs to be modified.

The ATR method is one of methods of measuring infrared absorption spectrum and uses a total reflection, which closely contacts an ATR prism having high flexibility to a sample and irradiates infrared to the sample through the prism to spectroanalyze outgoing light there from. When infrared enters the prism at an angle not less than a certain angle, the infrared does not come out and totally reflects at a contact point between the ATR prism and the sample due to a relationship between the flexibilities thereof. Then, the infrared comes out to the sample at a slight distance, and the reflected light attenuates an absorption spectrum of the sample can be obtained if the sample absorbs infrared.

The ATR method has an advantage of being capable of measuring absorption spectra of thick or low-transmission samples if the ATR prism can closely contact them because of being capable of measuring an absorption spectrum at a very thin place contacting the ATR prism of a sample. In addition, the ATR method is frequently used for qualitative analysis because a functional group is found from a wave number at which infrared is absorbed. However, this has not basically been used for quantitative analysis because the peak intensity of the absorption spectrum varies due to a pressure to a sample.

However, the present inventors thought to estimate even a rough amount of a protectant coated on a photoreceptor and performed ATR measurements on various conditions to compare and analyze the spectra. As a result, since the penetration depth of infrared varies depending on the prism used and an incident angle, the spectrum differs from each other even when the same sample is measured. In addition, a peak only from the photoreceptor, a peak almost only from the protectant or peaks from both of them were detected. The present inventors studied whether the amount of the protectant on the photoreceptor can be measured from a spectrum including peaks from both of them.

Since the peak intensity varies depending on a pressure to a sample in the ATR method, samples each having a different application time of a protectant by a protectant applicator were measured so as to keep a fixed gap between a jig and a prism fixing the sample when set. It was proved that a ratio of a peak area from the protectant to a peak area from the photoreceptor in the spectrum increases in proportion to the coating time.

Consequently, the peak area ratio obtained by the ATR method can calculate a relative amount of the protectant adhering to the photoreceptor. Therefore, the amount of the protectant adhering an arbitrary point of the photoreceptor can be calculated and variation of the amount thereof according to the sites can be obtained. When the variation of the amount of the protectant adhering to the photoreceptor was small, high-quality images could be produced for long periods. When large, abnormal images due to abraded photoreceptor were produced. Therefore, it was necessary to know the acceptable variation of the amount of the protectant adhering to the photoreceptor according to the sites, and which was specified.

In the present invention, n of n-pieces of the arbitrary points i selected in an image forming area of the image bearer along its longitudinal direction is preferably not less than 20, and more preferably not less than 30. When less than 20, the variation $\Delta Xi$ in an image forming area of Xi according to the sites is not fully known. 25 are enough to know the variation. Namely, when too many, it takes too much time to determine the index X.

In the present invention, an average amount of the zinc stearate and the zinc palmitate adhering to the image bearer is from 0.4 to 2.0 $\mu g/cm^2$, preferably from 0.5 to 1.8 $\mu g/cm^2$, and more preferably from 0.7 to 1.5 $\mu g/cm^2$ after 500 images are produced.

When less than 0.4 $\mu g/cm^2$, the abrasion of a photoreceptor is not sufficiently reduced. When greater than 2.0 $\mu g/cm^2$, toner components are likely to adhere to a photoreceptor and blurred images are produced because the protectant is present too much on a photoreceptor.

The protectant of the present invention includes a mixture of zinc stearate and zinc palmitate, and they are preferably main components. Namely, the protectant of the present invention includes zinc stearate and zinc palmitate in an amount not less than 55% by weight in total. A mixing ratio by weight of the zinc stearate to the zinc palmitate for use in the image forming apparatus of the present invention is preferably from 75/25 to 40/60, and more preferably from 66/34 to 40/60.

A mixture of the zinc stearate to the zinc palmitate is preferably used because of the following reason. The zinc stearate in the shape of a block is scraped with a brush to fine particles which are extended with a blade, but is not fully extended occasionally when the linear speed of a photoreceptor becomes fast. However, when the zinc palmitate having a smaller molecular weight than the zinc stearate is added thereto, the protectant including the zinc stearate and the zinc palmitate is extended on a photoreceptor with a blade to fully cover the photoreceptor.

The zinc stearate and the zinc palmitate are both aliphatic metallic salts, and the zinc stearate has 18 carbon atoms and the zinc palmitate has 16 carbon atoms at aliphatic sites, respectively. Therefore, the zinc stearate and the zinc palmitate have similar structures and natures. They are compatible with each other and behave as almost same materials. Since the zinc palmitate has a lower melting point than the zinc stearate, the resultant protectant is more easily extended when the zinc stearate includes the zinc palmitate in a specific amount or more.

When a photoreceptor has a higher linear speed, a charged energy, a particularly an AC charged energy, applied to the photoreceptor becomes stronger and a protectant thereon needs to have a larger thickness to increase the protect ability thereof. It is said that the zinc stearate does not randomly adhere to the photoreceptor and stably adheres thereto bimolecularly. Namely, even when the zinc stearate is applied to the photoreceptor, it is saturated when having its bimolecular thickness. When the zinc palmitate having a slightly shorter molecule than the zinc stearate is combined therewith, the molecular layer does not have a fixed height and lower and higher parts come to coexist. A following molecule enters the lower part to form a molecular layer. As a result, a protectant layer having a thickness larger than that of the bimolecular layer and the photoreceptor is more effectively protected.

The variation ΔXi of indices X according to places to the average Xave is less than 30%, and the following formula is satisfied:

$$\Delta Xi/Xave<0.3.$$

ΔXi/Xave is more preferably 0.25 or less, and even more preferably 0.2 or less. When not less than 0.3, the resultant images have uneven image density and the photoreceptor is likely to have sectional abrasion.

Infrared light does not reflect at the interface of a sample, and enters the sample at a specific depth and totally reflects. The depth is defined as a distance at which the intensity of the infrared light is 1/e thereof at the surface of the sample when emitted thereto. The depth differs according to an incident angle θ of the infrared light, a wavelength thereof or a refraction index of an ATR prism. The larger the incident angle θ, the larger the refraction index of the ATR prism the shorter the wavelength, the smaller the depth. Information closer to the surface of a photoreceptor is reflected on a spectrum.

In the present invention, the protectant on a photoreceptor is measured by ATR method using a Ge prism having a large refraction index as an ATR prism to obtain information closer to the surface of the photoreceptor. The incident angle of infrared light to a sample is 45°, which is capable of obtaining more precise index. Such a combination of the ATR prism and incident angle of infrared light can realize a preferable amount of the protectant coated on the surface of the photoreceptor.

The peak b comes from a stearic acid and a palmitic acid, and is preferably an index for estimating a protectant on a photoreceptor because of being detected as a peak having a sufficient intensity. The peak a comes from a polycarbonate bonding included in a photoreceptor and is preferably an index for estimating a protectant on the photoreceptor because of being detected as a peak having a sufficient intensity before the photoreceptor is coated with the protectant. The peaks a and b have comparatively close detected wavelengths, and preferably used because an index X (=Sa/Sb) for determining a coated amount has better sensitivity. A peak area in the present invention is determined, using an absorbance spectrum having good quantitative capability.

In the FT-IR analysis, simply following a peak area coming from a protectant is considered as a method of estimating an amount of the protectant coated (adhering) on a photoreceptor. In the ATR method, it is not preferable to directly follow a spectrum area (intensity) because the peak area (intensity) varies depending on a pressure pressing a sample. It is preferable to obtain a stable index of the coated amount using a ratio between a peak coming from the photoreceptor and a peak coming from the protectant. In the present invention, a stable index X is determined using a ratio (Sa/Sb) of an area of the peak a to an area of the peak b.

When a peak coming from the photoreceptor overlaps the peak b, the peak area thereof does not works as an index of the coated amount of the protectant occasionally because an area coming from the photoreceptor is added thereto. In this case, the following steps can obtain the index of an amount of the protectant adhering to a photoreceptor.

Figure 2:
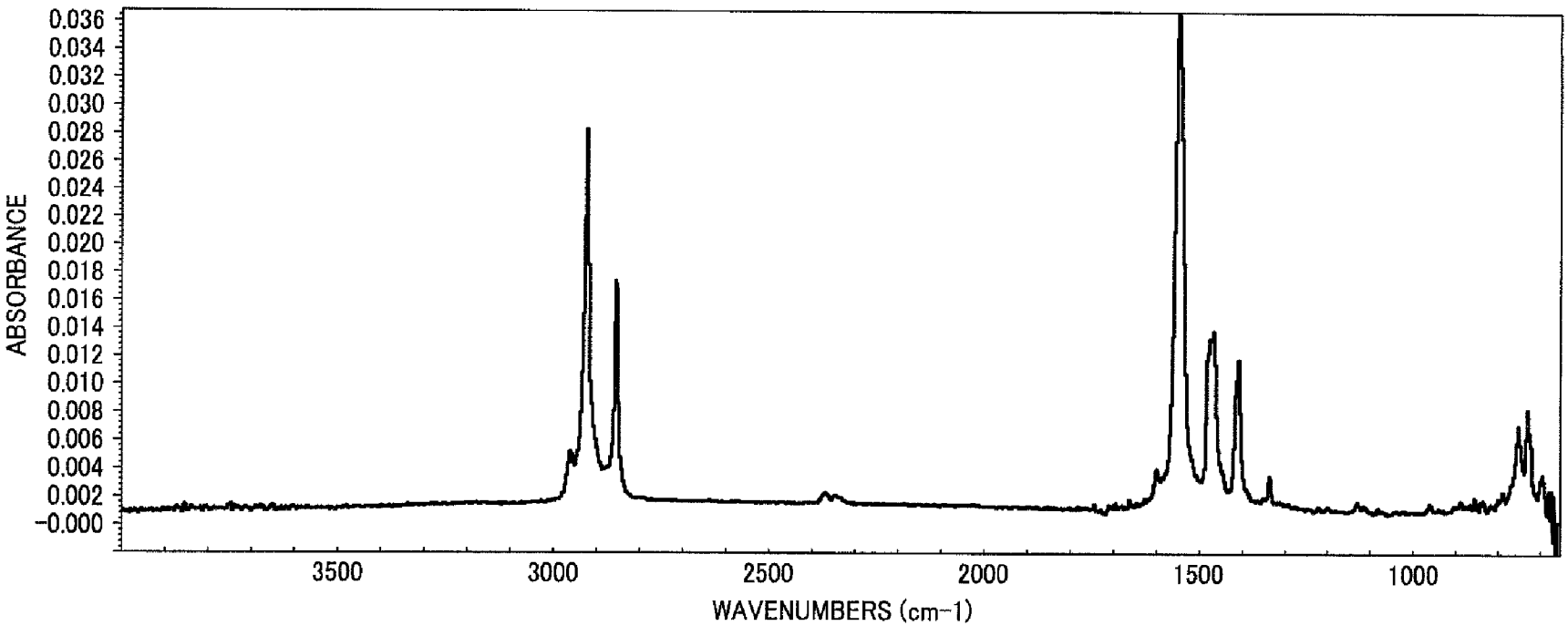
FIG. 2 is an IR spectrum M of the protectant.
Figure 3:
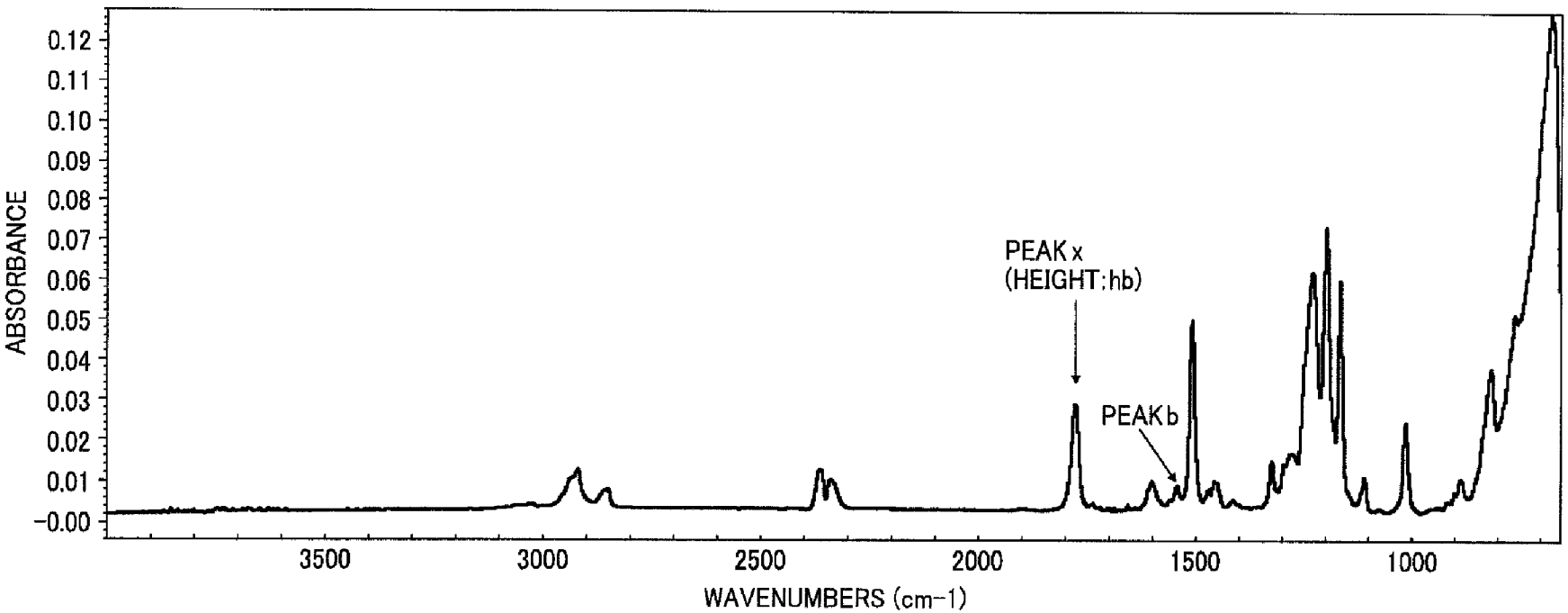
FIG. 3 is an IR spectrum B of the photoreceptor after producing images.
Figure 4:
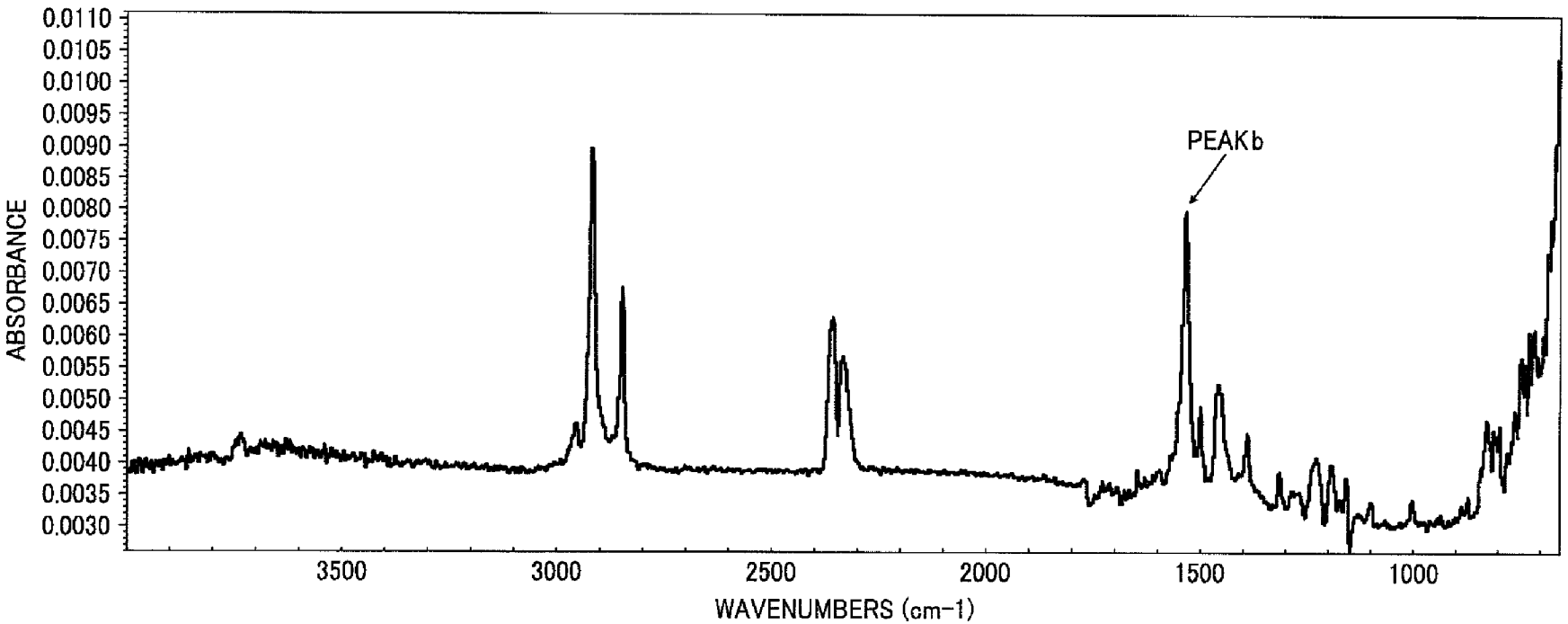
FIG. 4 is a difference spectrum C between the IR spectrum B and the IR spectrum A' which is an adjusted IR spectrum A.

The ATR-IR spectrum (hereinafter simply referred to as a spectrum) of an unused photoreceptor shown in FIG. 1 is spectrum A, the spectrum of a protectant (a mixture of the zinc stearate and the zinc palmitate) in FIG. 2 is spectrum M, and the spectrum of the photoreceptor after producing images equivalent to 500 pieces of recording papers shown in FIG. 3 is spectrum B. When the peak b of 1,540 $cm^{-1}$ overlaps a peak coming from the photoreceptor, one peak which does not overlap a peak present in the spectrum M is selected in the spectrum A. The selected peak is peak x (peak a of 1,770 $cm^{-1}$ is selected here), and the heights the peaks x in the spectrum A and the spectrum B are uniformed. Namely, when the peak x in the spectrum A has a height ha and the peak x in the spectrum B has a height hb, the spectrum A is multiplied by hb/ha to uniform the heights, and the spectrum A elongated and contacted to form a spectrum A'. The spectrum A' is deducted from the spectrum B to obtain a difference spectrum C as shown in FIG. 4. An area Sb of a peak b in the difference spectrum C is calculated and compared with an area Sa of a peak a in the spectrum B to determine a pure index X of the protectant adhering to the photoreceptor. When the peak x is overlapped with a peak of the protectant, another peak is preferably selected so as to be overlapped therewith.

The image forming apparatus of the present invention is equipped with a protection layer former having a blade as an applicator applying a mixture of the zinc stearate and the zinc palmitate to the photoreceptor besides a cleaner. Namely, when the cleaner uses a cleaning blade, the cleaner can be considered to play two roles with one blade used for both cleaning the photoreceptor and applying the mixture of the zinc stearate and the zinc palmitate thereto. However, in the present invention, the protection layer former is separated from the cleaner, which constantly applies a fixed amount of the protectant to the photoreceptor without influence of a toner because the toner is removed there from by the cleaner. The protection layer former preferably contacts its blade to the photoreceptor at such an angle as to contact thereto in the counter direction, which can form a thin and even protection layer thereon.

In the present invention, a protectant applicator applying a protectant to a photoreceptor may have a brush-shaped protectant application member and the protection layer former having a blade. In this case, the brush-shaped protectant application member applies a protectant to a photoreceptor and the protectant applied to the photoreceptor is formed to a thin layer by the blade of the protection layer former.

In the present invention, boron nitride (BN) is preferably included in the mixture of the zinc stearate and the zinc palmitate as a protectant. Self-lubricating BN reduces blade abrasion. The protectant preferably includes BN in an amount of from 2 to 30%, more preferably from 4 to 25%, and furthermore preferably from 6 to 20% by weight based on total weight of the mixture of the zinc stearate and the zinc palmitate. When greater than 30% by weight, BN is likely to accumulate on the photoreceptor, resulting in production of abnormal hollow images. When less than 20% by weight, self-lubrication of BN does not work.

When BN is included in the mixture of the zinc stearate and the zinc palmitate, alumina may be included therein as well. Alumina preferably grinds the mixture of BN, zinc stearate and zinc palmitate excessively applied to the surface of a photoreceptor. The protectant preferably includes the alumina in an amount of from 2 to 15%, more preferably from 3 to 10%, and furthermore preferably from 4 to 8% by weight based on total weight of the mixture of the zinc stearate and the zinc palmitate. When greater than 15% by weight, the alumina is likely to scratch the photoreceptor. When less than 2% by weight, the alumina does not sufficiently grind the mixture of BN, zinc stearate and zinc palmitate.

The alumina preferably has a particle diameter of from 0.05 to 0.5 μm, more preferably from 0.1 to 0.4 μm, and furthermore preferably from 0.2 to 0.3 μm. When less than 0.05 μm, the alumina does not sufficiently grind the mixture of BN, zinc stearate and zinc palmitate. When greater than 0.5 μm, the alumina is likely to scratch the photoreceptor.

In the present invention, a powder of the mixture of the zinc stearate and the zinc palmitate may directly be applied to a photoreceptor. However, it is more preferable that the mixture thereof is formed to a (protectant) bar which is scraped and applied to a photoreceptor with a brush, etc., to improve storage ability and applicability of the protectant and simplify the applicator.

Methods of forming the protectant bar include a method of melting the zinc stearate and the zinc palmitate at a temperature not lower than their melting points to prepare a melted mixture, placing the melted mixture into a mold and cooling the mixture; and a method of compressing the zinc stearate and the zinc palmitate. The protectant bar formed by the method of compressing the zinc stearate and the zinc palmitate is more preferably used than that formed by the method of melting them because it can stably be applied to a photoreceptor even when the brush is pressed thereto at a strength lower than that formed by the method of melting the zinc stearate and the zinc palmitate. Therefore, there is no shortage of the protectant application due to deterioration of the brush. When a powder such as BN and alumina is mixed with the zinc stearate and the zinc palmitate, the method of compressing the zinc stearate and the zinc palmitate can form a protectant bar in which the mixtures are well mixed if fully mixed in the form of powder.

The protectant block mainly including the zinc stearate and the zinc palmitate is prepared in a compression mold or a melt mold. A powder mainly including the zinc stearate and a powder mainly including the zinc palmitate are mixed to prepare a mixed powder, and which is placed and compressed in the compression mold. The zinc stearate and the zinc palmitate may be mixed each in the form of powder. However, the zinc stearate and the zinc palmitate are likely to be eccentrically-located on a photoreceptor, each having a specific size. Therefore, the zinc stearate and the zinc palmitate are preferably compatible with each other in a particle. Methods of making the zinc stearate and the zinc palmitate compatible with each other in a particle include a method of melting and mixing them to prepare a mixture, and cooling and pulverizing the mixture to prepare a powder in which the zinc stearate and the zinc palmitate are compatible with each other; and a conventional dry or wet method used for preparing a metallic soap with a mixture of a predetermined amount of each of the zinc stearate and the zinc palmitate to prepare a powder in which they are compatible with each other. Particularly, a ratio between the zinc stearate and the zinc palmitate as a material in the mixture of a predetermined amount of each thereof remains almost same in the resultant product, and not only the zinc stearate and the zinc palmitate are perfectly compatible with other but also the productivity is very high.

The hardness of the protectant block differs depending on a compression degree when formed in the compression mold. Since a true specific gravity and an amount of the protectant placing in the mold is previously known, a protectant block can be prepared as desired if compressed so as to have a desired thickness.

The protectant block is preferably compressed at a compression degree from 88 to 98%, and more preferably from 90 to 95% based on a true specific gravity thereof. When less than 88%, the resultant protectant block has lower mechanical strength and easily has a crack. When greater than 98%, the compressor needs to have higher capacity and the resultant protectant block partially melts, and which causes large partial different hardness thereof.

The protectant block prepared in the compression mold at a compression degree of from 88 to 98% can be pulverized with a brush even when the brush pressure is lower than that to a protectant block prepared in the melt mold. Therefore, the brush does not deteriorate as time passes and the protectant can stably be applied to a photoreceptor.

When a protectant block is prepared in the melt mold, after the zinc stearate and the zinc palmitate are melted and mixed to prepare a melted protectant, the melted protectant is cast into the mold and cooled to prepare a protectant block.

The thus prepared protectant block is attached to a substrate such as metals, metal alloys and plastics with an adhesive, etc.

A ratio between the zinc stearate and the zinc palmitate in a protectant block may be determined by amounts of their materials, however, is preferably measured per lot because the materials definitely includes impurities. The ratio can be measured by dissolving a protectant block in a hydrochloric acid-methanol solution; heating the solution to methylate the stearic acid and palmitic acid at 80° C.; measuring a ratio between the stearic acid and palmitic acid by gas chromatography; and exchanging the ratio into a ratio between the zinc stearate and the zinc palmitate.

In the present invention, a photoreceptor rotates at a linear speed of 180 mm/sec. When the linear speed is too fast, a protectant is not evenly applied to the photoreceptor occasionally. However, in the present invention, the zinc palmitate included in the zinc stearate in a specific amount in a protectant more easily expands the protectant, and the protectant can be applied to a photoreceptor even when rotating at a linear speed of 180 mm/sec.

Figure 5A:
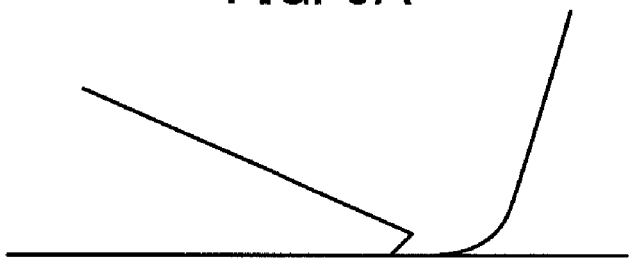
FIGS. 5A and 5B are images showing how two different edges of blade scrape the surface of a photoreceptor.
Figure 5B:
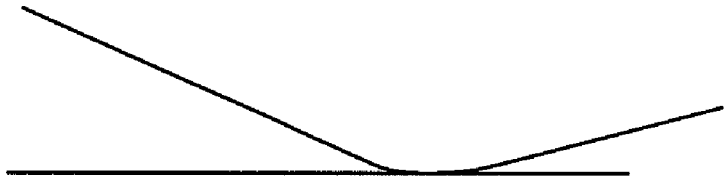

In the present invention, the blade for applying a protectant to a photoreceptor is preferably an obtuse blade. FIGS. 5A and 5B are images showing how two different edges of blade scrape the surface of a photoreceptor. When the blade contacts a photoreceptor at a right angle, the edge of the blade is likely to be dragged in the rotational direction of the photoreceptor. Meanwhile, the obtuse blade has a shape very difficult to be dragged, and stably contacts a photoreceptor and oscillates less. Therefore, a protectant (a mixture of the zinc stearate and the zinc palmitate) is stably applied to a photoreceptor. In addition, since BN included in a protectant does not scrape through the obtuse blade, the obtuse blade effectively regulates an amount of BN.

Figure 6:
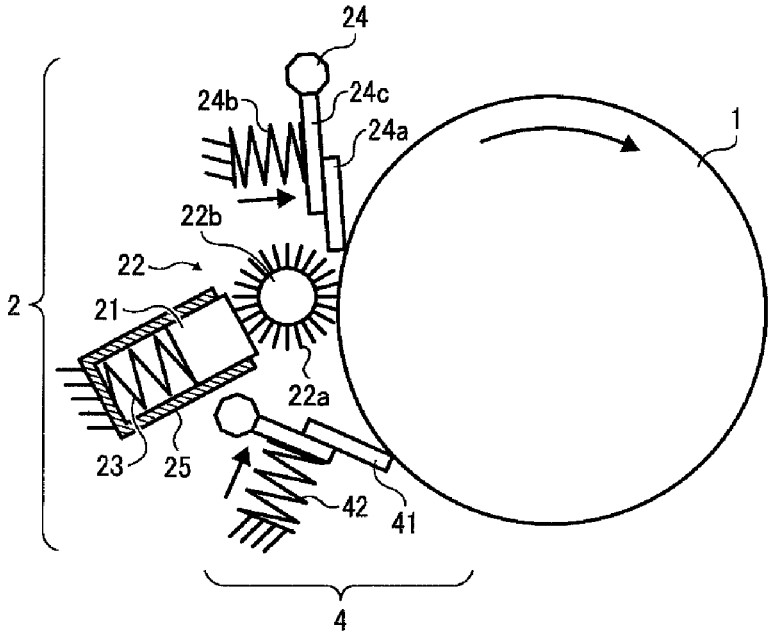
FIG. 6 is a schematic view illustrating a main part of the image forming apparatus of the present invention.

FIG. 6 is a schematic view illustrating a main part of the image forming apparatus of the present invention. A protectant applicator 2 located facing a drum-shaped photoreceptor 1 mainly includes a protectant bar 21 protecting the photoreceptor in the shape of a cylinder, a quadrangular prism, a hexagonal cylinder, etc., mainly formed of the zinc stearate and the zinc palmitate; a protectant bar holding guide 25 holding the protectant bar 21 so as not to sway from side to side, and back and forth; a protectant application member 22 having a brush 22*a* contacting the protectant bar 21 and applying the protectant transferred onto the brush 22*a* to the photoreceptor 1; a pressure applicator 23 such as a spring pressing the protectant bar 21 to the brush 22*a* of the protectant application member 22 to transfer the protectant onto the brush 22*a* of the protectant application member 22; and a protection layer former 24 forming a thin layer of the protectant applied to photoreceptor by the protectant application member 22. The protectant bar 21 for use in the present invention is prepared by a method of melting the zinc stearate and the zinc palmitate to prepare a melted mixture, placing the melted mixture into a mold and cooling the mixture; or a method of compressing powders of the zinc stearate and the zinc palmitate. In FIG. 6, Numeral 4 is a cleaner cleaning the photoreceptor, and which is located on the upstream side of the protectant applicator 2 in the rotational direction of the photoreceptor. The cleaner 4 cleans the surface of a photoreceptor before a protectant is applied thereto to smooth the application of a protectant, and can be regarded as one of the members of the protectant applicator 2.

In the present invention, the protectant bar 21 is pressed by the pressure applicator 23 such as a spring to the brush 22*a* of the protectant application member 22, and the protectant is transferred onto the brush 22*a* from the protectant bar 21. The protectant application member 22 rotates at a linear speed different from that of the photoreceptor 1 to scrape the surface thereof with the edge of the brush 22*a*. Then, the amorphous protectant held on the surface of the 22*a* of the protectant application member 22 is applied to the surface of the photoreceptor 1.

So as to make the protection layer formed of the protectant more uniform, the protectant applied to the surface of the photoreceptor 1 is formed to a thin layer by the protection layer former 24 having a blade-shaped member 24*a* and a press member 24*b* such as a spring pressing the blade-shaped member 24*a* to the surface of the photoreceptor 1. The protection layer former 24 uses a counter method and the blade-shaped member 24*a* contacts the surface of the photoreceptor in the counter direction.

Thus, a proper amount of an amorphous protectant is applied to the photoreceptor 1, and which is formed to a thin later by the protection layer former 24 to easily hold the protectant on the photoreceptor as an amorphous protection layer.

Therefore, an image forming apparatus capable of producing high-quality images for long periods without producing abnormal images due to a contaminated charger 3 such as a charging roller, in which consumables are less exchanged.

Instead of the protectant bar, a protectant powder can directly be applied to surface of a photoreceptor. In this case, a container containing the protectant powder and a protectant feeder feeding the protectant powder are needed, and the protectant bar, the presser and the protectant application member are not needed. The protectant feeder includes conventional powder feeders such as a pump and an auger.

Materials for the blade-shaped member (hereinafter referred to as a blade) 24*a* of the protection layer former 24 are not particularly limited, and include known elastic bodies for cleaning blades, such as a urethane rubber, a hydrin rubber, a silicone rubber and a fluorine-containing rubber. These can be used alone in combination. Contacts points of these rubber blades to the photoreceptor 1 may be coated or impregnated with a low-resistivity material. In addition, an organic or an inorganic filler may be dispersed in the elastic bodies to control the hardness thereof.

The blades 24*a* are fixed onto blade holders 24*c* by way of an adhesive or fusion bond such that the edges thereof are pressed to the surface of the photoreceptor. The thickness of the blade 24*a* is not unambiguously defined because of the pressure, however, preferably from 0.5 to 5 mm, and more preferably from 1 to 3 mm.

In addition, the free length of the blade 24*a* projected from the holder 24*c* and capable of having flexibility is not unambiguously defined because of the pressure, however, preferably from 1 to 15 mm, and more preferably from 2 to 10 mm.

The blade 24*a* for forming a protectant layer may be formed by forming a resin, a rubber or an elastomer layer on the surface of an elastic metal blade such as a leaf by coating or dipping methods with a coupling agent and a primer when necessary, and may be thermally-hardened and further subjected to surface grinding when necessary.

The elastic metal blade preferably has a thickness of from 0.05 to 3 mm, and more preferably from 0.1 to 1 mm. The elastic metal blade may be subjected to bending work in the direction parallel with the spindle after installed to prevent a twist of the blade.

Materials forming a surface layer of the elastic metal blade include fluorine-containing resins such as PFA, PTFE, FEP and PVdF; fluorine-containing rubbers; and silicone elastomers such as a methylphenyl silicone elastomer. These are used with a filler, but are not limited thereto.

The press member 24*b* of the protection layer former 24 preferably presses the blade 24*a* to the photoreceptor 1 at from 5 to 80 gf/cm, and more preferably from 10 to 60 gf/cm to expand a protectant on the surface of a photoreceptor to be a protection layer or film thereon.

The brush 22*a* is preferably used for the protectant application member 22, and the brush preferably has a flexible fiber. Specific examples of materials for the flexible brush fiber include known materials such as polyolefin resins, e.g., polyethylene and polypropylene; polyvinyl and polyvinylidene resins, e.g., polystyrene, acrylic resins, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; styrene-acrylic acid copolymers; styrene-butadiene resins; fluorine-containing resins, e.g., polytetrafluoroethylene, polyvinylfluoride, polyvinylidenefluoride and polychlorotrifluoroethylene; polyester; nylon; acrylic resins; rayon; polyurethane; polycarbonate; phenol resins; amino resins, e.g., urea-formaldehyde resins, melamine resins, benzoguanamine resins, urea resins and polyamide resins. These can be used alone or in combination. Diene rubbers, styrene-butadiene rubbers (SBR), ethylene propylene rubbers, isoprene rubbers, nitrile rubbers, urethane rubbers, silicone rubbers, hydrin rubbers, norbornene rubbers, etc. maybe combined to control the flexibility.

The protectant application member 22 includes a fixed or a rotatable roll-shaped holder 22*b*. The rolled-shaped application member includes a roll brush formed of a metallic shaft on which a brush fiber pile tape is spirally wound. The brush fiber preferably has a diameter of from 10 to 500 μm, and more preferably from 20 to 300 μm. When less than 10 μm, the protectant is applied very slowly. When greater than 500 μm, the protectant is unevenly applied to a photoreceptor because the number of the brush fibers present per a unit area decreases and the photoreceptor has some places the brushes do not contact, the brush fibers scratch the photoreceptor when contacting thereto, the protectant has a shorter life because of being scraped more strongly, the protectant applied to a photoreceptor becomes large particles and the particles transfer to a charging roller to contaminate the roller, and torque to rotate the brush or a photoreceptor becomes large.

The brush fiber preferably has a length of from 1 to 15 mm, and more preferably from 3 to 10 mm. When less than 1 mm, the shaft of the brush is too close to the photoreceptor, and is likely to contact and scratch the photoreceptor. When longer than 15 mm, since the strength at which the tip of the brush fiber scrapes the protectant and contacts the photoreceptor is low, the protectant is not sufficiently applied or brush fibers are likely to fall out.

The brush fiber density is from 10,000 to 300,000/square inch, i.e., from $1.5\times10^7$ to $4.5\times10^8/m^2$. When less than 10,000, the protectant is unevenly applied to a photoreceptor because the photoreceptor has some places the brushes do not contact and is not sufficiently applied thereto. When greater than 300,000, the brush fiber needs to have very small diameter.

The brush fiber density is preferably as high as possible in terms of uniform and stable application of the protectant. One fiber is preferably formed of from a few to a few hundred fine fibers. For example, as 333 decitex=6.7 decitex x×50 filaments (300 denier=5 denier×50 filaments), 50 fine fibers of 6.7 decitex (6 denier) can be implanted as one fiber.

The brush fiber is preferably a monofilament having a diameter of from 28 to 43 μm, and more preferably from 30 to 40 μm because such a fiber can efficiently apply the protectant to a photoreceptor. Fibers are mostly twisted and do not have uniform diameters, and units of denier and decitex are used. However, the monofilament has a uniform diameter and it is preferable to specify the protectant application member with the fiber diameter.

When the diameter is less than 28 μm, the protectant cannot efficiently be applied. When larger than 43 μm, the monofilament is so stiff that it is likely to scratch a photoreceptor. In addition, the monofilament having a diameter of from 28 to 43 μm is preferably implanted into the shaft electrostatically as vertically as possible. The shaft is coated with an adhesive and charged to electrostatically fly the monofilament to the adhesive on the shaft, and the adhesive is hardened. The brush on which 50,000 to 600,000 fibers are electrostatically implanted per square inch is preferably used.

The brush 22*a* may have a coated layer to stabilize the surface shape and environmental resistance. The coated layer preferably includes a deformable component in compliance with flexibility of the brush fiber. Specific examples thereof are not limited if they are capable of maintaining flexibility, and include polyolefin resins such as polyethylene, polypropylene, polyethylene chloride; chlorosulfonated polyethylene; polyvinyl and polyvinylidene resins such as polystyrene, acrylic resins, e.g., polymethylmethacrylate, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; silicone resins formed of organosiloxane bondings or their modified resins, e.g., modified alkyd resins, polyester resins, epoxy resins and polyurethane; fluorine-containing resins such as perfluoroalkylether, polyfluorovinyl, polyfluorovinylidene and polychlorotrifluoroethylene; polyamide; polyester; polyurethane; polycarbonate; amino resins such as urea-formaldehyde resins; epoxy resins; and their complex resins.

Figure 7:
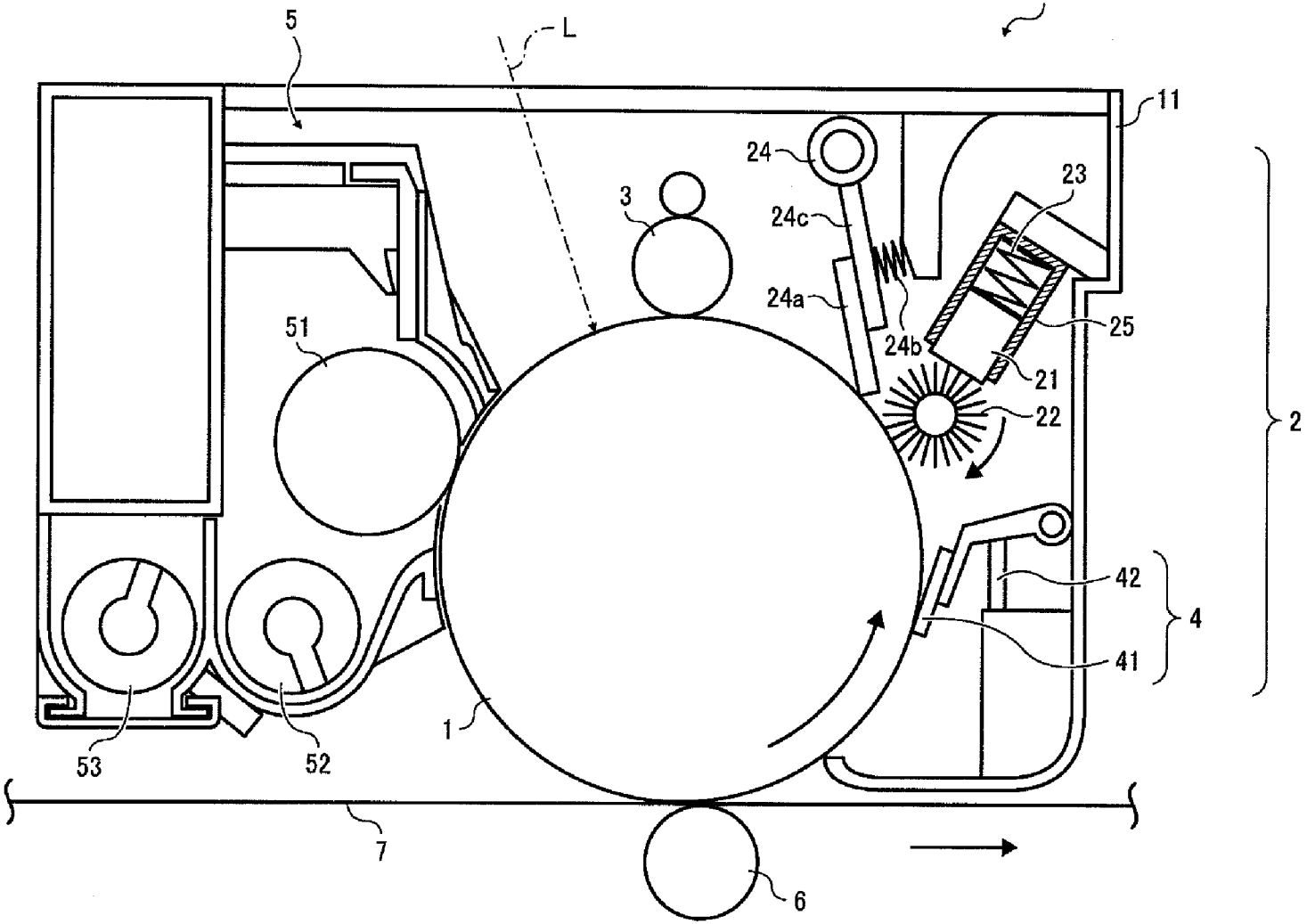
FIG. 7 is a schematic view illustrating a cross-section of the process cartridge for use in the image forming apparatus of the present invention.

Next, the process cartridge and image forming apparatus of the present invention will be explained. FIG. 7 is a schematic view illustrating a cross-section of a process cartridge 11 for use in the image forming apparatus of the present invention, and which has the protectant applicator 2 of the present invention. In FIG. 7, an image former 10 includes a drum-shaped photoreceptor 1 as an image bearer; a charger (charging roller) 3 charging the photoreceptor 1; an electrostatic latent image former (not shown) emitting a laser beam L to the charged photoreceptor 1 to form an electrostatic latent image thereon; an image developer 5 developing the latent image on the photoreceptor 1 with a toner to form a visual toner image; a transferor 6 transferring the toner image on the photoreceptor 1 onto a transfer medium (or an intermediate transfer medium) 7; a cleaner 4 removing the toner remaining on the surface of the photoreceptor 1; and a protectant applicator 2 located between the cleaner 4 and the charger 3; etc. The image former 10 uses a process cartridge 11 including the photoreceptor 1, the protectant applicator 2, the charger 3, the image developer 5 and the cleaner 4. In the present invention, the cleaner 4 cleans the surface of the photoreceptor before application of the protectant to be coated therewith smoothly and can be regarded as a part of the protectant applicator 2.

In FIG. 7, the charger 3, the latent image former (not shown) and the image developer 5 forms the image former, and the charger 3 is a charging roller applied with a DC voltage overlapped with an AC voltage from a high-voltage electric source (not shown). The image developer 5 includes a developing roller 51 bearing a developer including a toner and a carrier, and developer stirring members 52 and 53.

The protectant applicator 2 located facing the photoreceptor 1 mainly includes, similarly to FIG. 6, a protectant bar 21, a protectant application member 22, a pressure applicator 23, a protection layer former 24 and a protectant bar holding guide 25 holding the protectant bar 21 so as not to sway from side to side, and back and forth.

The cleaner 4 cleans the partially-deteriorated protectant and a toner remaining after transferred on the surface of the photoreceptor 1 with a cleaning member 41. The blade-shaped cleaning member 41 is held by a cleaning presser 42 and contacted to the photoreceptor 1 at an angle like a (leading) counter type. A blade-shaped member 24*a* of the protection layer former 24 is contacted thereto t an angle like a (leading) counter type as well.

The protectant of the protectant bar 21 is applied by the protectant application member 22 to the surface of the photoreceptor the residual toner and deteriorated protectant is removed from by the cleaner 4. The protectant applied to the surface of the photoreceptor is formed to a thin layer by the blade 24*a* of the protection layer former 24 to form an amorphous film-shaped protection layer. Since the protectant have better adsorptivity to a hydrophilic part of the surface of the photoreceptor due to an electrical stress, the protectant adsorbs to the photoreceptor to prevent deterioration thereof even when the surface thereof partially begins to deteriorate.

An electrostatic latent image is formed by irradiation with a laser beam L on the photoreceptor 1 the protectant layer is formed on after charged by the charging roller 3. The electrostatic latent image is developed by the image developer 5 with a toner to form a visual toner image. The toner image is transferred by the transferor 6 such as a transfer roller out of the process cartridge onto a transfer medium (or an intermediate transfer medium) 7 such a transfer paper.

A charging roller downsizable and less emitting oxidizing gas such as ozone is used as the charger 3 for use in the process cartridge 11. The charging roller 3 is located contacting the photoreceptor 1 or close thereto at a distance of from 20 to 100 μm. A DC voltage overlapped with an AC voltage is applied between the charging roller 3 and the photoreceptor 1 to charge the photoreceptor 1. Hundreds of discharges occur for a second between the photoreceptor 1 and the charging roller 3, which is likely to deteriorate the photoreceptor. Since the protectant is likely to deteriorate and disappear due to discharge, it is very important to apply a constant amount of the protectant to the photoreceptor 1.

The charging roller is preferably formed of an electroconductive substrate, a polymeric layer thereon and a surface layer thereon. The electroconductive substrate works as an electrode and a holder of the charging roller 3, and is formed of electroconductive materials, e.g., metals or metal alloys such as aluminum, copper alloys and stainless; irons plated with chrome or nickel; and resins including electroconductive materials.

The polymeric layer is preferably an electroconductive layer having a resistivity of from $10^6$ to $10^9$ Ω·cm, in which an electroconductive material is mixed with a polymeric material to adjust the resistivity. The polymeric materials in the polymeric layer include polyester and olefin thermoplastic elastomers; styrene thermoplastic resins such as polystyrene, styrene-butadiene copolymers, styrene-acrylonitrile copolymers and styrene-butadiene-acrylonitrile copolymers; isoprene rubbers; chloroprene rubbers; epichlorohydrin rubbers; butyl rubbers; urethane rubbers; silicone rubbers; fluorine-containing rubbers; styrene-butadiene rubbers; butadiene rubbers; nitrile rubbers; ethylene-propylene rubbers; epichlorohydrin-ethyleneoxide copolymer rubbers; epichlorohydrin-ethyleneoxide-allylglycidylether copolymer rubbers; ethylene-propylene-diene terpolymer rubbers; acrylonitrile-butadiene rubbers; natural rubbers; and their blended rubbers. Among these rubbers, the silicone rubbers, ethylene-propylene rubbers, epichlorohydrin-ethyleneoxide copolymer rubbers, epichlorohydrin-ethyleneoxide-allylglycidylether copolymer rubbers, acrylonitrile-butadiene rubbers and their blended rubbers are preferably used. These rubbers may be foamed or not.

The electroconductive materials include electron conductivizers and ion conductivizers. Specific examples of the electron conductivizers include fine powders of carbon blacks such as ketjen black and acetylene black; pyrolytic carbon grafite; electroconductive metals or metal alloys such as aluminum, copper, nickel, stainless; electroconductive metal oxides such as tin oxide, indium oxide, titanium oxide, tin oxide-antimony oxide solid solution and tin oxide-indium oxide solid solution; surface-conductived insulative materials; etc. Specific examples of the ion conductivizers include perchlorates and chlorates of tetraethylammonium, lauryltrimethylammonium, etc.; alkaline metals such as lithium and magnesium; perchlorates and chlorates of alkaline earth metals; etc. These electroconductive materials can be used alone or in combination. The electron conductivizers are preferably included in an amount of from 1 to 30 parts by weight, and more preferably from 15 to 25 parts by weight based on total weight of the polymeric materials. The ion conductivizers are preferably included in an amount of from 0.1 to 5.0 parts by weight, and more preferably from 0.5 to 3.0 parts by weight based on total weight of the polymeric materials.

The polymeric materials forming the surface layer are not particularly limited if the charging roller 3 has a surface having a dynamic nanohardness of from 0.04 to 0.5. Specific examples thereof include polyamide, polyurethane, polyfluorinated vinylidene, 4-fluorinated ethylene copolymers, polyester, polyimide, silicone resins, acrylic resins, polyvinylbutyral, ethylenetetrafluoroethylene copolymers, melamine resins, fluorine-containing rubbers, epoxy resins, polycarbonate, polyvinylalcohol, cellulose, polyvinylidenechrolide, polyvinylchloride, polyethylene, ethylenevinylacetate copolymers, etc. Among these polymeric materials, the polyamide, polyfluorinated vinylidene, 4-fluorinated ethylene copolymers, polyester and polyimide are preferably used in terms of releasability from a toner. The polymeric materials can be used alone or in combination. The polymeric materials preferably have a number-average molecular weight from 1,000 to 100,000, and more preferably from 10,000 to 50,000.

The surface layer is formed of the polymeric materials wixed with the conductivizers used in the electroconductive elastic layer and particulate materials. Specific examples of the particulate materials include, but are not limited to, polymeric fine powders of metal oxides and complex metal oxides such as silicone oxide, aluminum oxide and barium titanate; tetrafluoroethylene; fluorinated vinylidene; etc. These can be used alone or in combination.

The image developer for use in the process cartridge of the present invention contact a developer to the photoreceptor to develop a latent image formed thereon to a toner image. The developer includes a two-component developer formed of a toner and a carrier, and a one-component developer not including a carrier. As shown in FIG. 7, the image developer 5 partially exposes a developing roller 51 as a developer bearer from an opening of its casing.

A toner fed from a toner bottle (not shown) into the image developer 5 is fed onto the developing roller 51 while stirred by stirring feed screws 52 and 53. The developing roller 51 includes a magnet roller generating a magnetic field and a developing sleeve coaxially rotating around the magnet roller. The carrier in the developer is fed to a developing area facing the photoreceptor drum 1 in a form of ear-up by a magnetic force generated by the magnet roller. The developing roller 51 rotates at a linear speed faster than that of the photoreceptor drum 1 in the same direction thereof in the developing area. The carrier in a form of ear-up on the developing roller 51 feeds a toner adhering to the surface thereof to the surface of the photoreceptor drum 1 while scraping the surface thereof. A bias from an electric source (not shown) is applied to the developing roller 51 to from a developing electric field in the developing area. Then, an electrostatic force is applied to the toner on the developing roller 51 to be headed to the electrostatic latent image between the electrostatic latent image on the photoreceptor drum 1 and the developing roller 51. Then, the toner on the developing roller 51 adheres to the electrostatic latent image on the photoreceptor drum 1. The adherence develops the electrostatic latent image on the photoreceptor drum 1 to a toner image.

Figure 8:
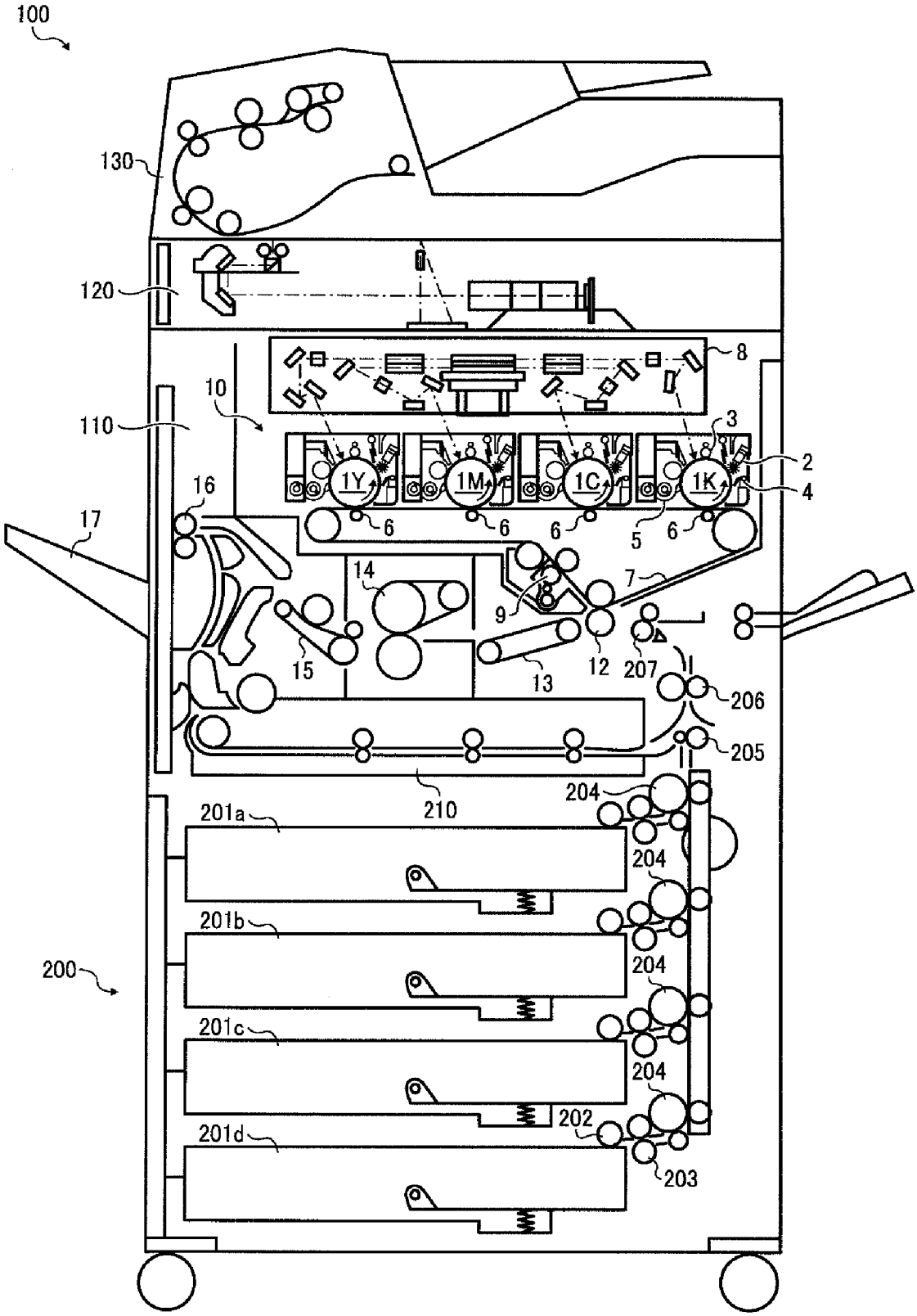
FIG. 8 is a schematic view illustrating the image forming apparatus of the present invention.

Another embodiment of the image forming apparatus of the present invention will be explained. FIG. 8 is a schematic view illustrating the image forming apparatus 100 including the protectant applicator of the present invention. The image forming apparatus 100 is a copier including a body of image forming apparatus (printer) 110, an image reader (scanner) 120 located on the body 110, an automatic document feeder (ADF) 130 located on the image reader (scanner) 120 and a paper feeder 200 below the body 110. The image forming apparatus 100 has a communicator with an outer apparatus and can be used as a printer and a scanner when connected with an outer personal computer, etc. Further, it can be used as a facsimile as well when connected with phone lines or optical lines.

The body of image forming apparatus 110 includes four image forming stations 10 forming four different color, i.e., yellow (Y), magenta (M) cyan (c) and black (K) toner images, respectively. The respective color toner images are transferred onto a transfer medium or an intermediate transfer medium while overlapped to form a multiple or full color image. In FIG. 8, each of the image forming station 10 is located along an intermediate transfer medium 7 suspended by plural rollers. After the respective color toner images are sequentially transferred onto the intermediate transfer medium 7 while overlapped, they are transferred onto a sheet-shaped transfer medium such as a paper by a second transferor 12 at a time.

Each of the image forming station 10 has a constitution similar to FIG. 7, and a protectant applicator 2, a charger 3, an irradiator emitting a laser beam, etc. from a latent image former 8, an image developer 5, a first transferor 6 and a cleaner 4 are located around each of drum-shaped photoreceptors 1 (1Y, 1M, 1C and 1K). Further, similarly to FIG. 7, each of the image forming station 10 uses a process cartridge 11 including the photoreceptor 1, protectant applicator 2 including the cleaner 4, charger 3 and image developer 5, and which is detachable from the body of image forming apparatus 110.

The operation in the image forming apparatus in FIG. 8 will be explained in a nega-posi process. Since each of the image forming station 10 has the same operation, the operation of one of them will be explained.

The drum-shaped photoreceptor 1 as an image bearer typified by an organic image photoconductor (OPC) having an organic photoconductive layer is discharged by a discharge lamp (not shown) and negatively and evenly charged by the charger 3 having a charging member such as a charging roller. When the charger 3 charges the photoreceptor 1, a voltage applicator (not shown) applies a suitable DC voltage or the DC voltage overlapped with an AC voltage to the charger 3 such that the photoreceptor 1 has a desired potential.

The charged photoreceptor 1 is irradiated with a laser beam emitted by the laser scanning latent image former 8 including plural laser light sources, a coupling optical system and a light deflector to form a latent image thereon (a potential absolute value of an irradiated part is lower than that a non-irradiated part). Namely, a laser beam emitted from the laser light source such as a laser diode is deflected by the light deflector such as a polygonal polygon mirror rotating at a high speed, and scans the surface of the photoreceptor 1 in the rotational (main scanning) direction thereof through a scanning imaging optical system including a scanning lens and a mirror.

The thus formed latent image is developed with a toner or a developer including a toner and a carrier fed on the developing sleeve of the developing roller 51 as a developer bearer of the image developer 5 to form a visual toner image. When the latent image is developed, a voltage applicator (not shown) applies a suitable DC voltage or the DC voltage overlapped with an AC voltage to the developing sleeve of the developing roller 51 between the irradiated part and non-irradiated part of the photoreceptor 1.

Each of the color toner images formed on the image forming stations 10 is sequentially transferred while overlapped by the first transferor 6 including a transfer roller onto the intermediate transfer medium 7 first. Meanwhile, a paper feed mechanism including a paper feed roller 202 and separation roller 203 feeds a sheet-shaped transfer medium from a paper feed cassette selected from multi-stage paper feed cassettes 201*a*, 201*b*, 201*c* and 201*d* of a paper feeder 200 in timing for the image forming operation and first transfer operation, and the sheet-shaped transfer medium is fed to a second transfer position though feed rollers 204, 205 and 206, and a registration roller 207. The toner image on the intermediate transfer medium 7 is secondly transferred onto the transfer medium by the second transferor 12 such as a second transfer roller. Each of the first transferor 6 and the second transferor 12 is preferably applied with a potential reverse to that of a toner as a transfer bias.

After the second transfer, the transfer medium is separated from the intermediate transfer medium 7 and a transferred image is obtained. The toner remaining on the photoreceptor 1 is collected by a cleaning member 41 of the cleaner 4 to a toner collection chamber therein. The toner remaining on the intermediate transfer medium 7 after the second transfer is collected by a cleaning member of a belt cleaner 9 to a toner collection chamber therein.

The image forming apparatus 100 in FIG. 8 is a tandem intermediate transfer image forming apparatus including plural image forming stations 10 along the intermediate transfer medium 7, in which plural different color toner images sequentially formed by each of the image forming stations 10 on each of the photoreceptors 1Y, 1M, 1C and 1K are sequentially transferred onto the intermediate transfer medium 7 and transferred onto a transfer medium such as a paper at a time. The transfer medium the toner image is transferred on is fed to a fixer 14 by a feeder 13, and the toner is fixed on the transfer medium with a heat, etc. The transfer medium the toner image is fixed on is discharged onto a paper tray 17 by a feeder 15 and a paper discharge roller 16. The image forming apparatus 100 is capable of printing both sides of the transfer medium, switches a feed path on the downstream of the fixer 9, reverses the transfer medium an image is fixed on a side thereof through a both-side printing feeder 210, feeds it to the second transfer position again with the feed roller 206 and the registration roller 207, and transfers an image on the other side thereof. As mentioned above, the transfer medium a toner image is transferred on is fed to the fixer 9, where the toner image is fixed on the transfer medium, and the transfer medium the toner image is fixed on is discharged onto the paper tray 17.

Direct transfer methods can be used in the above-mentioned tandem image forming apparatus without using the intermediate transfer medium, which uses a transfer belt bearing the transfer medium instead of intermediate transfer medium, directly and sequentially transfers plural different color toner images sequentially formed by each of the image forming stations 10 on each of the photoreceptors 1Y, 1M, 1C and 1K onto the transfer medium such as a paper fed by the transfer belt, feeds the transfer medium to the fixer, where the toner image is fixed thereon.

Next, the photoreceptor preferably used in the process cartridge and the image forming apparatus of the present invention will be explained. The photoreceptor as an image bearer for use in the image forming apparatus of the present invention includes an electroconductive substrate and a photosensitive layer thereon. The photosensitive layer includes a single layer mixing a charge generation material (CGM) and a charge transport material (CTM); ordinarily-layered layer including a charge generation layer (CGL) and a charge transport layer (CTL) thereon; and a reverse layer including a charge transport layer (CTL) and a charge generation layer (CGL) thereon. The photoreceptor can have a surface protection layer on the photosensitive layer to improve the mechanical strength, abrasion resistance, gas resistance and clean ability thereof. The photoreceptor may have an undercoat layer between the photosensitive layer and the electroconductive substrate. Each of the layers can include a plasticizer, an antioxidant, a leveling agent, etc. when necessary.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, etc., or a metal oxide such as tin oxides, indium oxides, etc., is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing, etc. can also be used as the substrate. The drum-shaped substrate preferably has a diameter of from 20 to 150 mm, more preferably from 24 to 100 mm, and furthermore preferably from 28 to 70 mm. When less than 20 mm, a charger, an irradiator, an image developer, a transferor and a cleaner are physically difficult to locate around the drum. When greater than 150 mm, the image forming apparatus becomes large. Particularly for the tandem image forming apparatus having plural photoreceptors as shown in FIG. 8, the drum preferably has a diameter not greater than 70 mm, and more preferably not greater than 60 mm. Further, endless belts of a metal such as nickel and stainless steel, which have been disclosed in Japanese published unexamined application No. 2005-0040051, can also be used as the electroconductive substrate.

The undercoat layer includes a resin, a mixture of a white pigment and a resin or an oxidized metallic film which is a chemically or electrically oxidized surface of the electroconductive substrate, among which the mixture of a white pigment and a resin is preferably used. Specific examples of the white pigment include metal oxides such as a titanium oxide, an aluminum oxide, a zirconium oxide and a zinc oxide, among which the titanium oxide preventing a charge from being injected to the undercoat layer from the electroconductive substrate is preferably included therein. Specific examples of the resin for use therein include thermoplastic resins such as polyamide, polyvinylalcohol, casein and methylcellulose; and thermosetting resins such as an acrylic resin, a phenol resin, a melamine resin, an alkyd resin, an unsaturated polyester resin and an epoxy resin. These can be used alone or in combination. The undercoat layer may be single or multiple.

Specific examples of the charge generation material include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine dyes, styryl dyes, pyrylium dyes, quinacridone dyes, indigo dyes, perylene dyes, polycyclic quinone pigments, bisbenzimidazole pigments, indanthrone pigments, Squarilium pigments and phthalocyanine pigments; and inorganic materials such as serene, serene-arsenic, serene-tellurium, cadmium sulfide, zinc oxide, titanium oxide and amorphous silicone. These charge generation materials can be used alone or in combination.

Specific examples of the charge transport material include anthracene derivatives, pyrene derivatives, carbazole derivatives, tetrazole derivatives, metallocene derivatives, phenothiazine derivatives, pyrazoline derivatives, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, triphenylmethane derivatives, etc. These can be used alone or in combination.

Specific examples of binder resins for use in forming the photosensitive layer including the charge generation layer and the charge transport layer include, but are not limited to, insulative thermoplastic resins such as polyvinylchloride, polyvinylidenechloride, vinylchloride-vinylacetate copolymers, vinylchloride-vinylacetate-maleic anhydride copolymers, ethylene-vinylacetate copolymers, polyvinylbutyral, polyvinylacetal, polyester, phenoxy resins, (metha)acrylic resins, polystyrene, polycarbonate, polyarylate, polysulfone, polyethersulfone and ABS resins; thermosetting resins such as phenol resins, epoxy resins, urethane resins, melamine resins, isocyanate resins, alkyd resins, silicone resins and thermosetting acrylic resins; and photoconductive resins such as polyvinyl carbazole, polyvinyl anthracene and polyvinyl pyrene. These can be used alone or in combination. However, a resin including polycarbonate is used when the charge transport layer is an outermost surface layer.

Specific examples of the antioxidant include monophenolic compounds such as 2,6-di-t-butyl-p-cresol, butylated hydroxyanisole, 2,6-di-t-butyl-4-ethylphenol, n-octadecyl-3-(4'-hydroxy-3',5'-di-t-butylphenol) and 3-t-butyl-4-hydroxyanisole; bisphenolic compounds such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol) and 4,4'-butylidenebis-(3-methyl-6-t-butylphenol); phenolic polymer compounds such as 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester and tocophenol compounds; paraphenylenediamine compounds such as N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine; hydroquinone compounds such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone; organic sulfur-containing compounds such as dilauryl-3,3'-thiodipropionate, distearyl-3,3'-thiodipropionate and ditetradecyl-3,3'-thiodipropionate; and organic phosphorus-containing compounds such as triphenylphosphine, tri(nonylphenyl)phosphine, tri(dinonylphenyl)phosphine, tricresylphosphine and tri(2,4-dibutylphenoxy)phosphine.

Specific examples of the plasticizer include plasticizers for typical resins, such as dibutylphthalate and dioctylphthalate, and each layer preferably includes the plasticizer in an amount of from 0 to 30 parts by weight per 100 parts by weight of the binder resin.

Specific examples of the leveling agent include silicone oil such as dimethyl silicone oil and methylphenyl silicone oil; and polymers or oligomers having a perfluoroalkyl group in the side chain, and each layer preferably includes the leveling agent in an amount of from 0 to 1 part by weight per 100 parts by weight of the binder resin.

Polymericmaterials for use in the surface protection layer preferably have transparency to writing light when forming an image, and high insulativity, mechanical strength and adhesiveness. The photoreceptor has an outermost surface layer including polycarbonate.

Particulate metals or metal oxides can be dispersed in the surface protection layer to increase the mechanical strength thereof. Specific examples of the metal oxides include alumina, titanium oxide, tin oxide, kalium titanate, $TiO_2$, TiN, zinc oxide, indium oxide and antimony oxide. Besides, fluorine-containing resins such as polytetrafluoroethylene, silicone resins, materials including these resins and inorganic materials dispersed there in, etc. can be included in the surface protection layer to improve abrasion resistance thereof.

The photoreceptor has been explained as an image bearer, however, the image bearer may be the intermediate transferor medium transferring toner images formed on photoreceptors to overlap colors and further transferring the overlapped color toner images onto a transfer medium, which is used when forming images by intermediate transfer methods.

The intermediate transferor medium is preferably has electroconductivity having a volume resistivity of from $10^5$ to $10^{11}$ Ω·cm. When less than $10^5$ Ω·cm, a toner image is distorted with a discharge when transferred from a photoreceptor onto the intermediate transferor medium. When greater than $10^{11}$ Ω·cm, an opposing charge of a toner image remains on the intermediate transferor medium after transferred there from to a transfer medium such as a paper, and occasionally appears as an accidental image on a following image.

The intermediate transferor medium can be prepared by kneading metal oxides such as tin oxide and indium oxide, electroconductive particulate materials such as carbon black or electroconductive particulate polymers alone or in combination with thermoplastic resins to prepare a mixture; and extruding the mixture to form a belt-shaped or cylindrical plastic. Besides, including the electroconductive particulate materials or electroconductive particulate polymers when necessary in a resin liquid including a crosslinkable monomer or oligomer to prepare a mixture, and centrifugally casting the mixture while heating to form an intermediate transferor medium in the shape of an endless belt.

When a surface layer is formed on the intermediate transferor medium, the materials except for the charge transport materials for forming the protection surface layer of a photoreceptor can be used, adjusting the resistivity with an electroconductive material when necessary.

A toner preferably used in the process cartridge and the image forming apparatus of the present invention will be explained.

A toner for use in the image forming apparatus of the present invention preferably has an average circularity of from 0.93 to 1.00. The circularity SR is defined as follows:

SR=a peripheral length of a circle having an area equivalent to that of a projected area of a particle/a peripheral length of a projected image of the particle.

The closer a toner to a true sphere, the closer the SR to 1.00. The more complicated the surface of the circle, the less the SR. When a toner has an average circularity of from 0.93 to 1.00, the toner has smooth surface and has good transferability because of having a small contact area with another toner or a photoreceptor. Since the toner has no corner, a developer including the toner is stably stirred in the image developer to prevent production of abnormal images, a pressure is evenly applied to the toner when transferred onto the transfer medium to prevent production of hollow images, and the toner does not scratch or abrades the surface of a photoreceptor.

The circularity is measured with flow-type particle image analyzer FPIA-1000 from SYSMEX CORP. A measurement liquid was prepared by the following method and set therein:

0.1 to 0.5 ml of a surfactant (alkylbenzenesulfonate salt) was added to 100 to 150 ml of water impurities were ready removed from as a dispersant to prepare an aqueous solution;

adding 0.1 to 0.5 g of a measurement sample thereto; and dispersing the aqueous solution with an ultrasonic disperser for 1 to 3 min to prepare a measurement liquid including 3,000 to 10,000 pieces/pl.

In addition to the circularity, the toner preferably has a weight-average particle diameter D4 of from 3 to 10 μm. Having sufficiently small particle diameter, the toner has good dot reproducibility of microscopic latent dots. When less than 3 μm, the transferability and clean ability of the toner deteriorates. When greater than 10 μm, it is difficult to prevent letters and lines from scattering.

Further, the toner preferably has a ratio (D4/D1) of the weight-average particle diameter D4 to a number-average particle diameter D1 of from 1.00 to 1.40. The closer to 1.00, the sharper the particle diameter distribution the toner has. Therefore, the toner having the ratio of from 1.00 to 1.40 produces stable-quality images. The toner has a sharp friction charged quantity distribution as well to prevent production of foggy images. Further, a toner having a uniform particle diameter has good dot reproducibility because the toner is precisely and orderly developed on a latent dot.

The particle diameter distribution of a toner can be measured by a Coulter counter TA-II or Coulter Multisizer II from Coulter Electronics, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Such an almost spherical toner is preferably prepared by crosslinking and/or elongating a toner composition including a polyester prepolymer having a functional group including a nitrogen atom, polyester, a colorant and a release agent in an aqueous medium under the presence of a particulate resin. The thus prepared toner has a hardened surface to decrease hot offset contaminating the fixer.

Prepolymers formed of modified polyester resins used for preparing a toner include polyester prepolymers having an isocyanate group (A), and compounds elongatable or crosslinkable with the prepolymer include amines (B).

The polyester prepolymer having an isocyanate group (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used. Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used. Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used.

Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used.

Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenedisocyanate and diphenylmethanediisocyanate; aromatic aliphatic diisocyanates such as α,α,α',α'-tetramethylxylylenediisocyanate; isocyanurates; the above-mentioned polyisocyanates blocked with phenol derivatives, oxime and caprolactam; and their combinations. The polyisocyanate (3) is mixed with polyester such that an equivalent ratio ([NCO]/[OH]) between an isocyanate group [NCO] and polyester having a hydroxyl group [OH] is typically from5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates. A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, the hot offset resistance of the resultant toner deteriorates, and in addition, the heat resistance and low-temperature fixability of the toner also deteriorate. In contrast, when the content is greater than 40% by weight, the low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine, etc. Specific examples of the polyamines (B2) having three or more amino groups include diethylenetriamine, triethylenetetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine (B1) is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, the molecular weight of the urea-modified polyester (i) decreases, resulting in deterioration of hot offset resistance of the resultant toner. The urea-modified polyester (i) may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester (i) can be prepared by a method such as a one-shot method or a prepolymer method. The weight-average molecular weight of the urea-modified polyester (i) is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the urea-modified polyester (i) has priority over the number-average molecular weight thereof when combined with an unmodified polyester (ii) mentioned later. However, when the urea-modified polyester (i) is used alone, the number-average molecular weight is not greater than 20,000, preferably from 1,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, an unmodified polyester resin (ii) can be used in combination with the urea-modified polyester resin (i) as a toner binder resin. It is more preferable to use the unmodified polyester resin (ii) in combination with the modified polyester resin than to use the urea-modified polyester resin alone because low-temperature fixability and glossiness of full color images of the resultant toner improve. Specific examples of the unmodified polyester resin (ii) include polycondensed products between the polyol (1) and polycarboxylic acid (2) similarly to the urea-modified polyester resin (i), and the components preferably used are the same as those thereof. It is preferable that the urea-modified polyester resin (i) and unmodified polyester resin (ii) are partially soluble with each other in terms of the low-temperature fixability and hot offset resistance of the resultant toner. Therefore, the urea-modified polyester resin (i) and unmodified polyester resin (ii) preferably have similar compositions. When the unmodified polyester resin (ii) is used in combination, a weight ratio ((i)/(ii)) between the urea-modified polyester resin (i) and unmodified polyester resin (ii) is from 5/95to80/20, preferably from 5/95 to 30/70, more preferably from 5/95 to 25/75, and most preferably from 7/93 to 20/80. When the urea-modified polyester resin (i) has a weight ratio less than 5%, the resultant toner has poor hot offset resistance, and has difficulty in having a thermostable preservability and low-temperature fixability.

The unmodified polyester resin (ii) preferably has a peak molecular weight of from 1,000 to 20,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 mg KOH/g, the resultant toner has difficulty in having thermostable preservability and low-temperature fixability. The unmodified polyester resin (ii) has an acid value of from 1 to 30 mg KOH/g, and more preferably from 5 to 20 mg KOH/g such that the resultant toner tends to be negatively charged.

The binder resin preferably has a glass transition temperature (Tg) of from 50 to 70° C., and more preferably from 55 to 65° C. When less than 50° C., a thermostable preservability of the resultant toner deteriorates. When greater than 70° C., a low-temperature fixability thereof is insufficient. A dry toner including the unmodified polyester resin (ii) and the urea-modified polyester resin (i) has a better thermostable preservability than known polyester toners even though the glass transition temperature is low.

The binder resin preferably has a temperature at which a storage modulus of the toner binder resin is 10,000 dyne/cm$^2$ at a measuring frequency of 20 Hz (TG'), of not less than 100° C., and more preferably of from 110 to 200° C. When less than 100° C., the hot offset resistance of the resultant toner deteriorates. The toner binder resin preferably has a temperature at which the viscosity is 1, 000 poise (Tη), of not greater than 180° C., and more preferably of from 90 to 160° C. When greater than 180° C., the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the thermostable preservability and low-temperature fixability of the resultant toner, the difference between TG' and η (TG'−Tη) is preferably from 0 to 100° C., more preferably from 10 to 90° C., and most preferably from 20 to 80° C.

The binder resin can be prepared, for example, by the following method. The polyol (1) and polycarboxylic acid (2) are heated at a temperature of from 150 to 280° C. in the presence of a known catalyst such as tetrabutoxy titanate and dibutyltinoxide. Then, water generated is removed, under a reduced pressure if desired, to prepare a polyester resin having a hydroxyl group. Then the polyester resin is reacted with the polyisocyanate (3) at a temperature of from 40 to 140° C. to prepare a prepolymer having an isocyanate group (A). Further, the prepolymer (A) is reacted with an amine (B) at a temperature of from 0 to 140° C. to prepare a urea-modified polyester.

When (3), and (A) and (B) are reacted, a solvent can be used if desired. Suitable solvents include solvents which do not react with (PIC). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran. When the unmodified polyester (ii) is used in combination with the ura-modified polyester (i), a method similar to a method for preparing a polyester resin having a hydroxyl group is used to prepare the unmodified polyester (ii), and which dissolved and mixed in a solution after a reaction of the urea-modified polyester (i) is completed.

The toner can be prepared by, but is not limited to, the following method. The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner may be prepared by reacting a dispersion including the prepolymer having an isocyanate group (A) with the amine (B) in an aqueous medium, or may use a previously-prepared unrea-modified polyester (i). As a method of stably preparing a dispersion formed of the prepolymer (A) and the unmodified polyester resin (ii) in an aqueous medium, a method of including a toner constituent formed of the prepolymer (A) and the unmodified polyester resin (ii) into an aqueous medium and dispersing them upon application of shear stress is preferably used. The prepolymer (A), the unmodified polyester resin (ii) and other toner constituents (hereinafter referred to as toner materials) such as colorants, master batch pigments, release agents and charge controlling agents, etc. may be added into an aqueous medium at the same time when the dispersion is prepared. However, it is preferable that the toner materials are previously mixed, and then are added to the aqueous medium. In addition, other toner materials such as colorants, release agents, charge controlling agents, etc., are not necessarily added to the aqueous dispersion before particles are formed, and may be added thereto after particles are prepared in the aqueous medium. For example, after forming particles without a colorant, a colorant can also be added thereto by known dying methods.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000rpm. The dispersion time is not also particularly limited, but is typically from 0.1 to 5 min. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

A content of the aqueous medium to 100 parts by weight of the toner constituent including the prepolymer (A) and the unmodified polyester resin (ii) or is typically from 50 to 2,000 parts by weight, and preferably from 100 to 1,000 parts by weight. When the content is less than 50 parts by weight, the dispersion of the toner constituent in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

The urea-modified polyester (i) may be prepared from the prepolymer (A) by adding amines (B) in the aqueous medium before or after the toner constituent is dispersed therein. The urea-modified polyester is preferentially formed on the surface of the resultant toner, and which can have a gradient of concentration thereof inside.

Specific preferred examples of the dispersants used to emulsify and disperse an oil phase in an aqueous liquid in which the toner constituent is dispersed, include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOPEF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including a toner constituent in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite, which are hardly soluble in water, can also be used. Further, it is possible to stably disperse a toner constituent in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calciumphosphate or a material soluble in alkaline is used as a dispersant, the calcium phosphate is dissolved with an acid such as a hydrochloric acid and washed with water to remove the calciumphosphate from the toner particle. Besides this method, it can also be removed by an enzymatic hydrolysis. When a dispersant is used, the dispersant may remain on a surface of the toner particle. However, the dispersant is preferably washed and removed after the elongation and/or crosslinking reaction of the prepolymer with amine in terms of chargeability of the resultant toner.

Further, to decrease viscosity of a dispersion medium including the toner constituent, a solvent which can dissolve the prepolymer (A) or the unmodified polyester resin (ii) can be used because the resultant particles have a sharp particle diameter distribution. The solvent is preferably volatile from the viewpoint of being easily removed from the dispersion after the particles are formed. Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed there from under a normal or reduced pressure after the particles are subjected to an elongation reaction and/or a crosslinking reaction of the prepolymer with amine.

The elongation and/or crosslinking reaction time depend on reactivity of the isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution. A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles. The fine and coarse particles may be wet when recycled. The dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles. Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Known pigments and dyes having been used as colorants for toners can be used as colorants for use in the electro photographic toner of the present invention. Specific examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination.

Further, to optionally impart magnetism to toner particles, magnetic components, i.e., iron oxides such as ferrite, magnetite and maghemite; metals such as iron, cobalt and nickel; or their alloyed metals with other metals are included in toner particles alone or in combination. In addition, these components can be used as colorants or with colorants.

The colorant in the toner of the present invention preferably has a number-average particle diameter not greater than 0.5 μm, more preferably not greater than 0.4 μm, and furthermore preferably not greater than 0.3 μm. When greater than 0.5 μm, the colorant does not have a sufficient dispersibility and the resultant toner does not have desired transparency. The colorant having a particle diameter less than 0.1 μm is basically considered not to have an adverse effect on light reflection and absorption of the resultant toner. The colorant having a particle diameter less than 0.1 μm contributes to transparency of an OHP sheet having good color reproducibility and image fixability. To the contrary, a large number of the colorants having a particle diameter greater than 0.5 μm tend to essentially deteriorate brightness and chromaticness of a projected image on an OHP sheet. Meanwhile, a large number of the colorants having a particle diameter greater than 0.5 μm are released from a surface of the toner particle, and tend to cause various problems such as background development, drum contamination and poor cleaning. The colorant having a number-average particle diameter not less than 0.7 μm is preferably not greater than 5% by number.

When the colorant is previously kneaded with a part or all of binder resins under the presence of a wetter, the colorant and the binder resins sufficiently adhere to each other and the colorant is effectively and stably dispersed even after any production process. The resultant toner includes well dispersed colorant, a small dispersion diameter thereof and has good transparency. Specific examples of the binder resin include, but are not limited to, the modified and unmodified polyester resins mentioned above.

Specific examples of the method of previously kneading a mixture of the binder resin, the colorant and the wetter include a method of mixing the binder resin, the colorant and the wetter by a blender such as Henschel mixers; and kneading the mixture by a kneader such as two-roll and three-roll mills at a lower temperature than a melting point of the binder resin. Specific examples of the organic solvent include typical organic solvents in consideration of solubility with the binder resin and wettability of the colorant. Particularly, organic solvents such as acetone, toluene, butanone or water are preferably used in terms of dispersibility of the colorant. Water is most preferably used in terms of environmental protection and the dispersion stability of the colorant in the following process of preparing a toner. The method not only makes the colorant have a small particle diameter nut also increase uniformity of the dispersion status thereof, and which improves color reproducibility of images projected by OHP more.

The toner may include a wax together with a toner binder and a colorant. Specific examples of the wax include known-waxes, e.g., polyolefin waxes such as polyethylene wax and polypropylene wax; long chain carbon hydrides such as paraffin wax and sasol wax; and waxes including a carbonyl group. Among these waxes, the waxes including a carbonyl group are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone.

Among these waxes including a carbonyl group, polyesteralkanate is preferably used. The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. A content of the wax in a toner is preferably from 0 to 40% by weight, and more preferably from 3 to 30% by weight.

The toner may include a charge controlling agent to obtain sufficient charge quantity and improve charge buildability. Materials almost colorless or white are preferably used because colored materials cause a color change of the resultant toner. Specific examples of the charge controlling agent include known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor or compounds including phosphor, tungsten or compounds including tungsten, fluorine-containing activators, metal salts of salicylic acid, salicylic acid derivatives, etc. Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent can be dissolved and dispersed after kneaded upon application of heat together with a master batch pigment and resin, can be added when directly dissolved and dispersed in an organic solvent or can be fixed on a toner surface after the toner particles are produced.

Particles resins may be added an aqueous medium when toner constituents are dispersed therein to stabilize the dispersibility. Any thermoplastic and thermosetting resins can be used provided they can form an aqueous medium. Specific examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. These resins can be used in combination. Among these resins, vinyl resins, polyurethane resins, epoxy resins, polyester resins and their combinations are preferably used because an aqueous medium including spherical particulate resins can easily be formed.

Specific examples of the vinyl resins include, but are not limited to, polymers formed of homopolymerized or copolymerized vinyl monomers such as styrene-(metha)esteracrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

As an external additive for improving fluidity, developability and chargeability of the colored particles of the present invention, inorganic particulate materials are preferably used. The inorganic particulate materials preferably have a primary particle diameter of from 5 nm to 2 μm, and more preferably from 5 nm to 500 nm. In addition, a specific surface area of the inorganic particulate materials measured by a BET method is preferably from 20 to 500 $m^2/g$. The content of the external additive is preferably from 0.01 to 5% by weight, and more preferably from 0.01 to2.0% by weight, based on total weight of the toner composition. Specific examples of the inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Other than these materials, particulate polymers such as polystyrene formed by a soap-free emulsifying polymerization, a suspension polymerization or a dispersing polymerization, estermethacrylate or esteracrylate copolymers, silicone resins, benzoguanamine resins, polycondensation particulate materials such as nylon and polymer particles of thermosetting resins can be used.

These fluidizers, i.e., surface treatment agents can increase hydrophobicity and prevent deterioration of fluidity and chargeability of the resultant toner even in high humidity. Specific examples of the surface treatment agents include silane coupling agents, sililating agents silane coupling agents having an alkyl fluoride group, organic titanate coupling agents, aluminium coupling agents silicone oils and modified silicone oils.

The toner may include a clean ability improver for removing a developer remaining on a photoreceptor and an intermediate transfer medium after transferred. Specific examples of the clean ability improver include fatty acid metallic salts such as zinc stearate, calcium stearate and stearic acid; and particulate polymers prepared by a soap-free emulsifying polymerization method such as particulate polymethylmethacrylate and particulate polystyrene. The particulate polymers comparatively have a narrow particle diameter distribution and preferably have a volume-average particle diameter of from 0.01 to 1 μm.

The toner has good developing stability and produces high-quality toner images. However, the toner remaining on an image bearer, which has not been transferred onto a transfer medium or an intermediate transfer medium, occasionally passes a cleaner because it is difficult to remove therewith due to its fineness and rollability. It is necessary to strongly press a toner removal member such as a cleaning blade to the image bearer to completely remove the toner there from. Such a load not only shortens lives of the image bearer and the cleaner bur also consumes extra energy. When a load to the image bearer is reduced, a toner on and a carrier having a small particle diameter thereon are not sufficiently removed there from, and which scratch the surface thereof when passing the cleaner and deteriorate the image forming apparatus.

The image forming apparatus of the present invention highly preventing variation of the surface conditions of a photoreceptor, particularly a low-resistivity part thereof, and variation of chargeability thereto produces high-quality images for long periods when using the toner. In addition, the image forming apparatus of the present invention can use an amorphous toner prepared by pulverization methods as well.

Constituents forming the toner prepared by the pulverization methods include those typically used in the electro photographic toners without a particular limit. Specific examples of the binder resin for use in the toner include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used alone or in combination, but the resins are not limited thereto. Among these resins, at least a resin selected from the group consisting of styrene-acrylic copolymer resins, polyester resins and polyol resins is preferably used to impart good electric properties to the resultant toner and decrease production cost thereof. Further, the polyester resins and/or the polyol resins are more preferably used to impart good fixability to the resultant toner.

As mentioned above, the charging member preferably has a coated layer including at least a member selected from linear polyester resin compositions, linear polyol resin compositions and a linear styrene-acrylic resin compositions.

The toner prepared by the pulverization methods can be prepared by pre-mixing the colorant, wax, charge controlling agent with the resin when necessary to prepare a mixture, kneading the mixture at a temperature not higher than a melting point of the resin to prepare a kneaded mixture, cooling the kneaded mixture to prepare a hardened mixture and pulverizing the a hardened mixture. In addition, the external additives may be added to the toner when necessary.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The image forming unit of the image forming apparatus (process cartridge) in Example is the same as shown in FIG. 7. A photoreceptor 1 used in Examples was prepared as follows.

An undercoat layer coating liquid, a CGL coating liquid, a CTL coating liquid and a protection layer coating liquid were coated in this order by a dip coating method, except that the protection layer was coated by a spray coating method, on an aluminum drum (electroconductive substrate) having a diameter of 30 mm, and dried to from an undercoat layer 3.6 μm thick, a CGL 0.14 μm thick, a CTL 22 μm thick, and a protection layer 5 μm thick thereon.

The protection layer had the following formulation.

| | |
|---|---|
| Z-type polycarbonate | 10 |
| Triphenylamine compound having the following formula: | 7 |

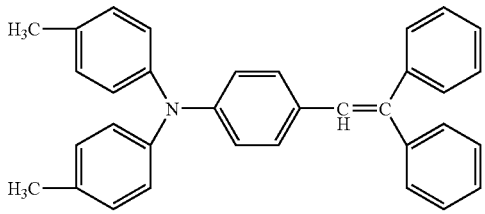

| | |
|---|---|
| Farticulate alumina having a diameter of 0.3 μm | 5 |
| Tetrahydrofuran | 400 |
| Cyclohexanone | 150 |

Protect powders including the zinc stearate and the zinc palmitate was prepared.

(Preparation of Powder 1)

60 parts of zinc stearate and 40 parts of zinc palmitate were dissolved by a hot stirrer at 160 to 250° C. while stirred. The dissolved zinc stearate and zinc palmitate were mixed at 160 to 250° C. and cast into a large aluminum mold previously heated to have a temperature of 150° C. After cooled, the solid was taken out from the mold and further cooled to have a room temperature. The solid was pulverized to prepare a powder 1. A ratio of the zinc stearate to the zinc palmitate was measured by gas chromatography. The weight ratio was approximately 60/40.

(Preparation of Powder 2)

77 parts of zinc stearate and 23 parts of zinc palmitate were dissolved by a hot stirrer at 160 to 250° C. while stirred. The dissolved zinc stearate and zinc palmitate were mixed at 160to 250° C. and cast into a large aluminum mold previously heated to have a temperature of 150° C. After cooled, the solid was taken out from the mold and further cooled to have a room temperature. The solid was pulverized to prepare a powder 2. A ratio of the zinc stearate to the zinc palmitate was measured by gas chromatography. The weight ratio was approximately 77/23.

(Preparation of Powder 3)

75 parts of zinc stearate and 25 parts of zinc palmitate were dissolved by a hot stirrer at 160 to 250° C. while stirred. The dissolved zinc stearate and zinc palmitate were mixed at 160 to 250° C. and cast into a large aluminum mold previously heated to have a temperature of 150° C. After cooled, the solid was taken out from the mold and further cooled to have a room temperature. The solid was pulverized to prepare a powder 3. A ratio of the zinc stearate to the zinc palmitate was measured by gas chromatography. The weight ratio was approximately 75/25.

(Preparation of Protectant Bars 1-1 to 1-6)

Zinc stearate and zinc palmitate were independently dissolved by a hot stirrer at 160 to 250° C. while stirred so as to have respective predetermined mixing (weight) ratios of six protectant bars 1-1 to 1-6. The dissolved zinc stearate and zinc palmitate were mixed at 160 to 250° C. and cast into an aluminum mold having an inner size of 12 mm×8 mm×350 mm previously heated to have a temperature of 150° C. After cooled on a wooden table to have a temperature of 40° C., the solid was taken out from the mold and further cooled to have a room temperature with a weight for preventing curvature. After cooled, both end in the longitudinal direction and the bottom surface of the solid were cut to prepare a protectant bar having a size of 7 mm×8 mm×310 mm. A double-sided adhesive tape was attached to the bottom surface of the protectant bar, and which was fixed on a metallic substrate. A chip after cut was dissolved in a hydrochloric acid-methanol solution and heated at 80° C. to methylate the stearic acid and the palmitic acid. A ratio of the stearic acid to the palmitic acid was measured by gas chromatography, and further exchanged to a ratio of the zinc stearate to the zinc palmitate. The (weight) ratios of the zinc stearate to the zinc palmitate of the six protectant bars 1-1 to 1-6 are shown in Table 1.

TABLE 1

| Protectant Bar | Ratio | | Remarks |
|---|---|---|---|
| | Zinc stearate | Zinc palmitate | |
| 1-1 | 60 | 40 | Used in Example 1 |
| 1-2 | 39 | 61 | Used in Comparative Example 1 |
| 1-3 | 28 | 78 | Used in Comparative Example 2 |
| 1-4 | 68 | 32 | Used in Comparative Example 3 |
| 1-5 | 67 | 33 | Used in Comparative Example 4 |
| 1-6 | 69 | 31 | Used in Comparative Example 6 |

(Preparation of Protectant Bar 2)

77 parts of the powder 1, 17 parts of BN (NX5 from Momentive Perfomance Materials, Inc.) and 6 parts of spherical particulate alumina having a diameter of 0.3 μm were mixed and stirred to prepare a mixed powder. The mixed powder was cast into an aluminum mold having an inner size of 8 mm×350 mm and pressurized with a hydraulic press. The mixed powder was compressed to be 95% of its absolute specific gravity to prepare a protectant bar having a thickness of 7 mm. Both end in the longitudinal direction and the bottom surface of the protect bar were cut to prepare a protectant bar 2 having a size of 7 mm×8 mm×310 mm. A double-sided adhesive tape was attached to the bottom surface of the protectant bar 2, and which was fixed onametallic substrate.

(Preparation of Protectant Bar 3A)

85 parts of the powder 1, 12 parts of BN (NX5 from Momentive Perfomance Materials, Inc.) and 3 parts of spherical particulate alumina having a diameter of 0.3 μm were mixed and stirred to prepare a mixed powder. The mixed powder was cast into an aluminum mold having an inner size of 8 mm×350 mm and pressurized with a hydraulic press. The mixed powder was compressed to be 95% of its absolute specific gravity to prepare a protectant bar having a thickness of 7 mm. Both end in the longitudinal direction and the bottom surface of the protect bar were cut to prepare a protectant bar 3A having a size of 7 mm×8 mm×310 mm. A double-sided adhesive tape was attached to the bottom surface of the protectant bar 3A, and which was fixed on a metallic substrate.

(Preparation of Protectant Bar 3B)

85 parts of the powder 2, 12 parts of BN (NX5 from Momentive Perfomance Materials, Inc.) and 3 parts of spherical particulate alumina having a diameter of 0.3 μm were mixed and stirred to prepare a mixed powder. The mixed powder was cast into an aluminum mold having an inner size of 8 mm×350 mm and pressurized with a hydraulic press. The mixed powder was compressed to be 95% of its absolute specific gravity to prepare a protectant bar having a thickness of 7 mm. Both end in the longitudinal direction and the bottom surface of the protect bar were cut to prepare a protectant bar 3B having a size of 7 mm×8 mm×310 mm. A double-sided adhesive tape was attached to the bottom surface of the protectant bar 3B, and which was fixed on a metallic substrate.

(Preparation of Protectant Bar 4)

75 parts of zinc stearate and 25 parts of zinc palmitate were independently dissolved by a hot stirrer at 160 to 250° C. while stirred. The dissolved zinc stearate and zinc palmitate were mixed at 160 to 250° C. and cast into an aluminum mold having an inner size of 12 mm×8 mm×350 mm previously heated to have a temperature of 150° C. After cooled on a wooden table to have a temperature of 40° C., the solid was taken out from the mold and further cooled to have a room temperature with a weight for preventing curvature. After cooled, both end in the longitudinal direction and the bottom surface of the solid were cut to prepare a protectant bar 4 having a size of 7 mm×8 mm×310 mm. A double-sided adhesive tape was attached to the bottom surface of the protectant bar 4, and which was fixed on a metallic substrate. A ratio of the zinc stearate to the zinc palmitate of the protectant bar 4 was measured by gas chromatography as the protectant bar 1-1 was measured. The weight ratio was approximately 75/25.

(Preparation of Protectant Bar 5)

85 parts of the powder 3, 12 parts of BN (NX5 from Momentive Perfomance Materials, Inc.) and 3 parts of spherical particulate alumina having a diameter of 0.3 μm were mixed and stirred to prepare a mixed powder. The mixed powder was cast into an aluminum mold having an inner size of 8 mm×350 mm and pressurized with a hydraulic press. The mixed powder was compressed to be 95% of its absolute specific gravity to prepare a protectant bar having a thickness of 7 mm. Both end in the longitudinal direction and the bottom surface of the protect bar were cut to prepare a protectant bar 5 having a size of 7 mm×8 mm×310 mm. A double-sided adhesive tape was attached to the bottom surface of the protectant bar 5, and which was fixed onametallic substrate.

Example 1

A tandem color image forming apparatus Imagio MPC3500 from RicohCompany, Ltd. as shown in FIG. 8 was modified to have plural image forming units (process cartridges) each having the protectant applicator of the present invention as shown in FIG. 7. The photoreceptor 1 was used as an image bearer at a linear speed of 125 mm/sec, a DC voltage of −600 V overlapped with an AC voltage having a frequency of 1,450 Hz and an amplitude of 1,100 V was applied between the photoreceptor and charging roller to form an image. The protectant bar 1-1 was used in the protectant applicator. A protectant application member 22 of the protectant applicator has a brush 22*a* using brush A having 5.3 denier and a density of 50,000 pieces/square inch, a protection layer former 24 and a cleaner 4 have urethane blades 24*a* and 41, respectively, and a spring 23 is a spring of 4.5 N. (Each part and device number is same as that in FIGS. 7 and 8.) The protectant bars and the specifications of brushes used in Examples and Comparative Examples are shown in Table 2.

TABLE 2

| | Protectant bar | Brush | | | |
|---|---|---|---|---|---|
| | | Brush | Denier | The number of fibers per square inch | Pressure (N) |
| Example 1 | 1-1 | A | 5.3 | 50,000 | 4.5 |
| Example 2 | 2 | A | 5.3 | 50,000 | 4.8 |
| Example 3 | 3A | A | 5.3 | 50,000 | 7 |
| Example 4 | 3A | A | 5.3 | 50,000 | 4.8 |
| Example 5 | 3A | A | 5.3 | 50,000 | 4.8 |
| Example 6 | 5 | A | 5.3 | 50,000 | 4.8 |
| Example 7 | 5 | A | 5.3 | 50,000 | 4.8 |
| Comparative Example 1 | 1-2 | B | 20 | 50,000 | 4.8 |
| Comparative Example 2 | 1-3 | C | 10 | 50,000 | 6 |
| Comparative Example 3 | 1-4 | A | 5.3 | 50,000 | 3 |
| Comparative Example 4 | 1-5 | B | 20 | 50,000 | 2.7 |
| Comparative Example 5 | 3B | D | 25 | 30,000 | 2 |
| Comparative Example 6 | 1-6 | A | 5.3 | 50,000 | 8 |
| Comparative Example 7 | 4 | A | 5.3 | 50,000 | 4.5 |
| Comparative Example 8 | 4 | A | 5.3 | 50,000 | 4.5 |

Figure 9:
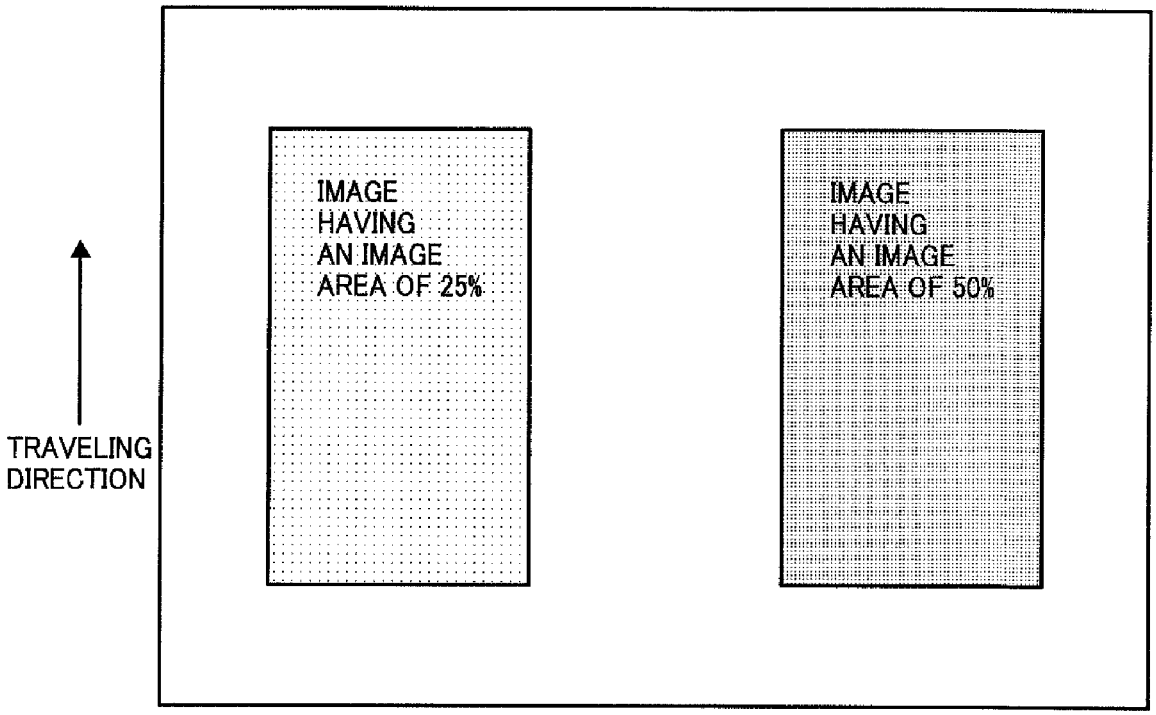
FIG. 9 is an embodiment of an image pattern to be produced for evaluation.

An image pattern in FIG. 9 was used to produce images for evaluation. After 500 image patterns in FIG. 9 were produced, an amount of a mixture of the zinc stearate and the zinc palmitate adhering to the photoreceptor was measured, using ICP emission spectral analysis and ATR method. The ICP emission spectral analysis can measure the amount of Zn. Since a content ratio of the zinc stearate and the zinc palmitate is known, a total amount thereof was determined from the total amount of Zn. As a sample for ICP emission spectral analysis, a photosensitive layer 25 cm long (almost equal to printing width) in the longitudinal direction (parallel with the shaft) and 3 cm wide in the circumferential direction was peeled off from the aluminum substrate of the photoreceptor after producing the image patterns. A total amount of the zinc stearate and the zinc palmitate adhering to the photoreceptor was 0.41 μg/cm$^2$. Since the protectant almost uniformly adhered thereto in the circumferential direction with a blade, the result can be regarded as an average total amount of the mixture of the zinc stearate and the zinc palmitate. Total amounts of the zinc stearate and the zinc palmitate adhering to the photoreceptor, subjected to ICP emission spectral analysis are shown in Table 3.

TABLE 3

| | Amount (μg/cm$^2$) | Maximum value of ΔXi/Xave | The number of image patterns produced | Evaluation Result |
|---|---|---|---|---|
| Example 1 | 0.41 | 0.11 | 60,000 | ○ |
| Example 2 | 0.85 | 0.28 | 60,000 | ○ |
| Example 3 | 1.96 | 0.27 | 60,000 | ○ |
| Example 4 | 0.92 | 0.23 | 60,000 | ○ |
| Example 5 | 0.77 | 0.25 | 60,000 | ○ |
| Example 6 | 0.88 | 0.24 | 60,000 | ○ |
| Example 7 | 0.81 | 0.26 | 60,000 | Δ |
| Comparative Example 1 | 2.12 | — | 60,000 | x |
| Comparative Example 2 | 3.09 | — | 60,000 | x |
| Comparative Example 3 | 0.33 | — | 60,000 | x |
| Comparative Example 4 | 1.95 | 0.32 | 60,000 | x |
| Comparative Example 5 | 1.52 | 0.45 | 60,000 | x |
| Comparative Example 6 | 0.52 | 0.32 | 25,000 | x |
| Comparative Example 7 | 0.38 | — | 60,000 | x |
| Comparative Example 8 | 0.34 | — | 60,000 | x |

Figure 10:
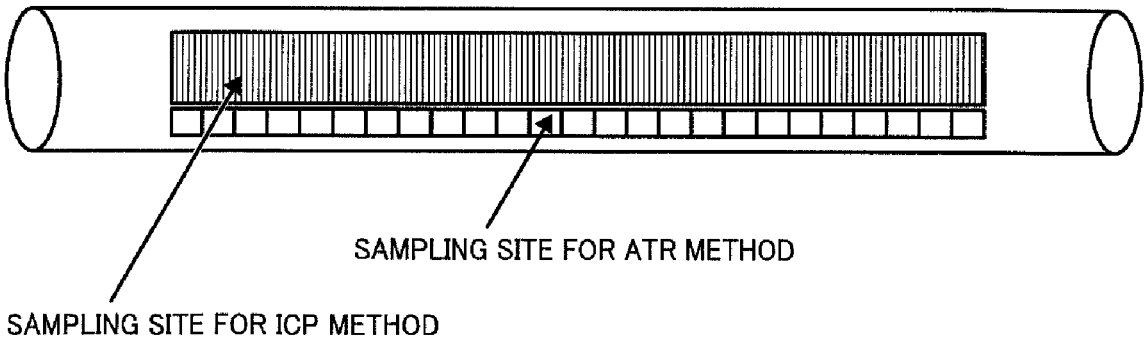
FIG. 10 is a schematic view of a photoreceptor, showing sampling sites for CIP and ATR methods.

Further, as a sample for ATR method, 25 pieces of the photosensitive layer having a size of 1 cm×1 cm next to the sampled part thereof for ICP emission spectral analysis were peeled off. Sampled parts for ICP emission spectral analysis and ATR method are shown in FIG. 10.

A photosensitive layer having a size of 1 cm×1 cm was peeled off from a brand-new photoreceptor as well as a sample for analysis. This does not need ICP emission spectral analysis because the zinc stearate and the zinc palmitate do not adhere thereto.

Figure 11:
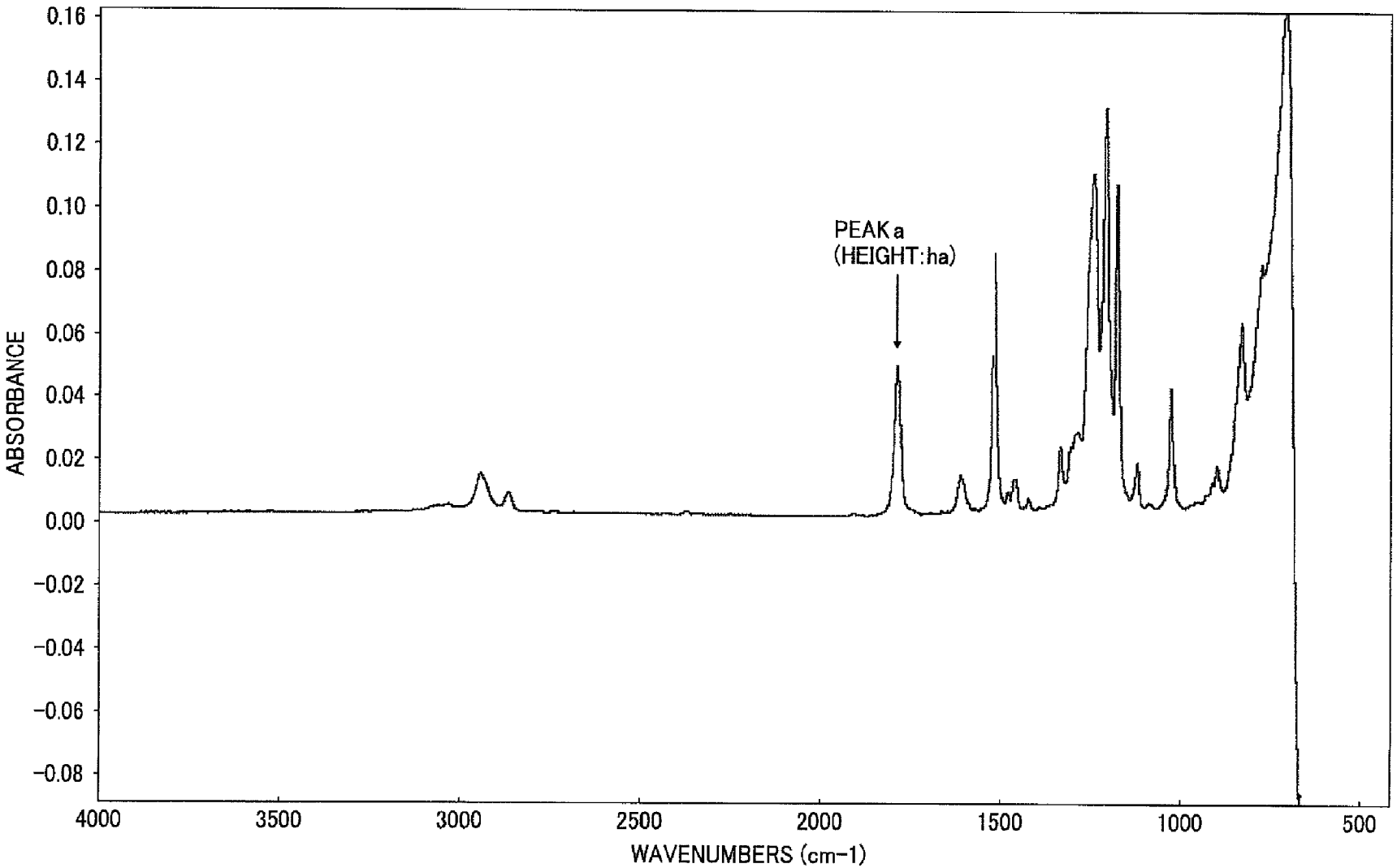
FIG. 11 is an IR spectrum 1 of a photoreceptor before applied with a protectant.
Figure 12:
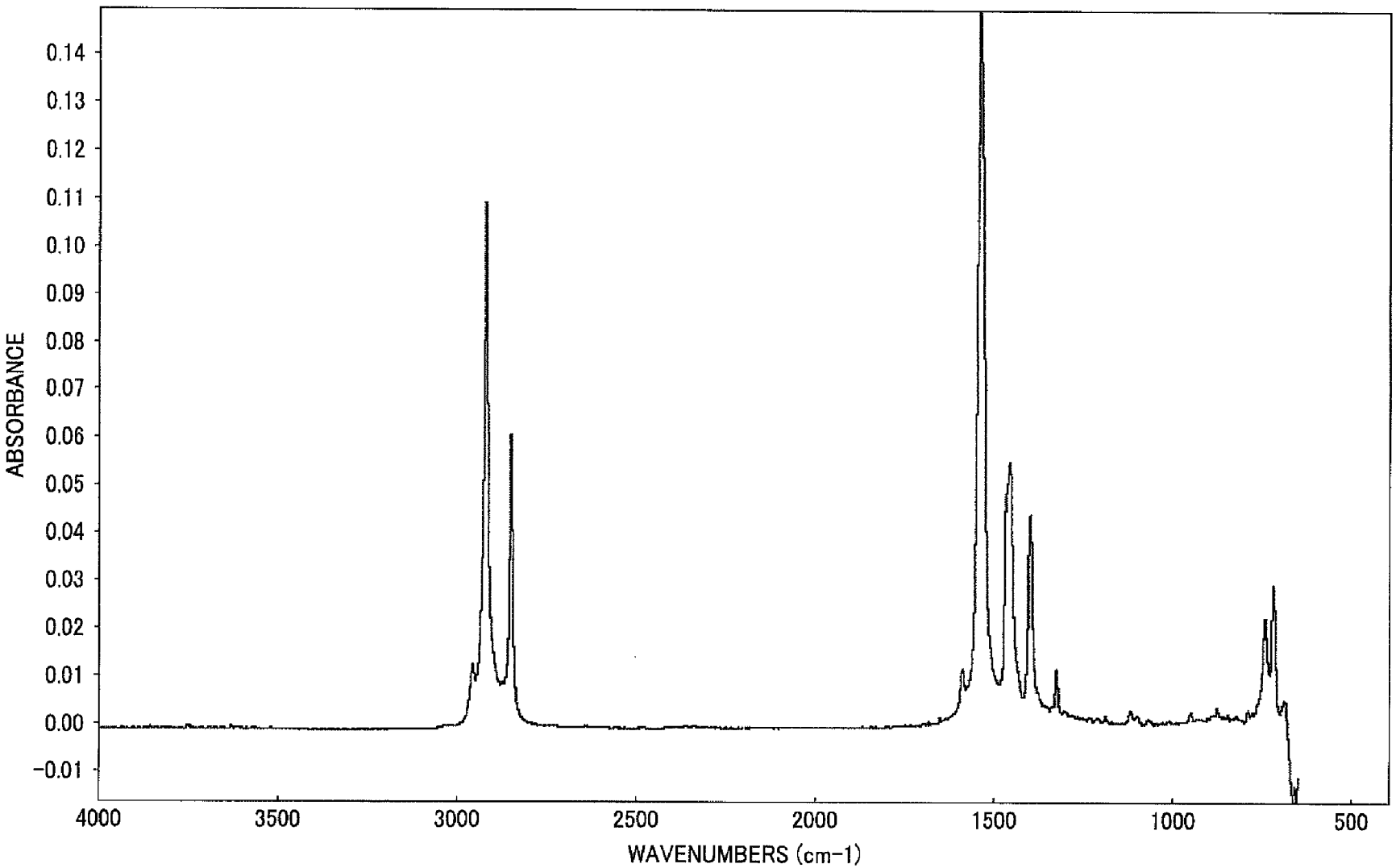
FIG. 12 is an IR spectrum 4 of ZnST powder.
Figure 13:
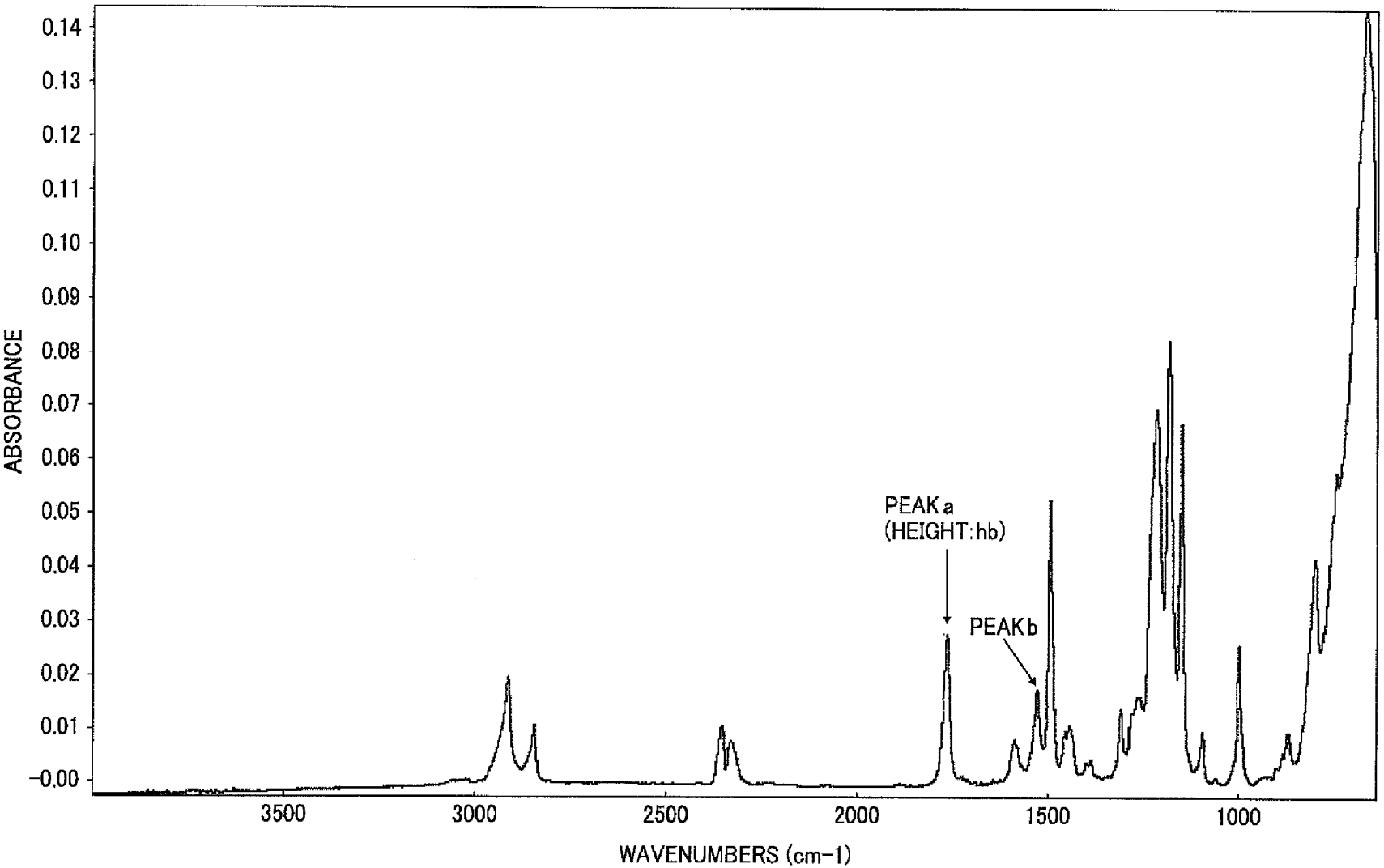
FIG. 13 is an IR spectrum 2 of the photoreceptor after producing images.

A sample from of the photoreceptor after producing 500 image patterns, a sample from a brand-new photoreceptor and a sample from the pulverized protectant bar 1-1 were subjected to ATR method IR analysis using FT-IR Avatar 370 from Thermo electron Corp., Thunder Dome (one reflection ATR Ge incident angle 45°). The IR spectra are shown in FIGS. 11 to 13. The spectrum in FIG. 11 is a spectrum 1 of the brand-new photoreceptor, the spectrum in FIG. 12 is a spectrum 4 of the pulverized protectant bar 1-1 and the spectrum in FIG. 13 is a spectrum 2 of the photoreceptor after producing 500 image patterns.

In the spectrum 1 in FIG. 11, a peak a from carbonate bonding was seen at 1,770 cm$^{-1}$. In the spectrum 2 in FIG. 13, a peak from carbonate bonding was seen at 1,770 cm$^{-1}$ and a peak b from zinc stearate and the zinc palmitate was seen at 1,540 cm$^{-1}$. The peak b did not overlap peaks from the photoreceptor, but when an area Sb of the peak b was calculated, the peaks from the photoreceptor overlapped an area where a base line is drawn. Therefore, the spectrum 1 was deducted from the spectrum 2 to modify the spectrum such that the baseline becomes flat. Namely, hb/ha (has is a height of the peak a in the spectrum 1 and hb is a height of peak a in the spectrum 2) was multiplied to the spectrum 1 to form a spectrum 1' to make a height of the peak a equal between the spectra 1' and 2. Then, the spectrum 1' was deducted from the spectrum 2 to from a difference spectrum 3 in FIG. 14.

Sa, Sb, Xi, Xave and ΔXi have been explained. Namely, an index X of an amount of the protectant adhering to an image bearer is Sb/Sa, and Sa and Sb represent peak areas in wave number domains of peaks a and b in an infrared absorption spectrum (IR spectrum) measured by attenuated total reflection (ATR) method at an arbitrary point i on the surface of the image bearer, respectively. Sa is a peak area of a peak (peak a) having a peak wave number domain of from 1,765 to 1,786 $cm^{-1}$ based on a wave number domain of from 1,751 to 1,801 $cm^{-1}$ in the spectrum 2 in FIG. 13. Sb is a peak area of a peak (peak a) having a peak wave number domain of from 1,533 to 1,547 $cm^{-1}$ based on a wave number domain of from 1,483 to 1,589 $cm^{-1}$ in the difference spectrum 3 in FIG. 14. i is the number corresponding to the 25 samples, Xave is an average of $X_1$ to $X_{25}$, a variation to Xave is ΔXi|Xi−Xave| and ΔXi/Xave is determined.

Figure 14:
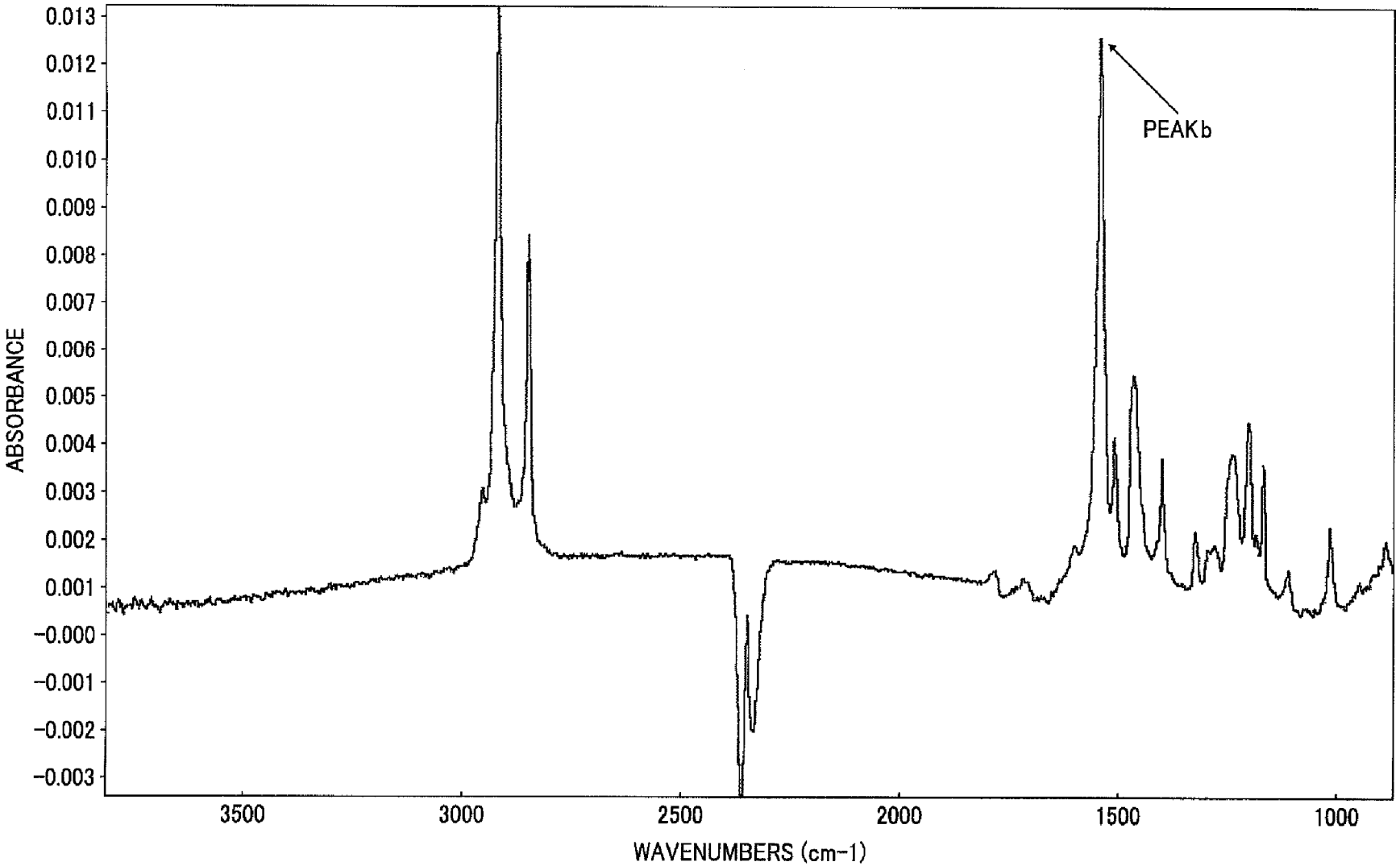
FIG. 14 is a difference spectrum 3.

An area Sa of peak a in spectrum 1 in FIG. 11 and an area Sb of peak b in a difference spectrum 3 in FIG. 14 for each of the 25 samples were measured, and Xi (i=1 to 25), Xave and ΔXi were calculated. The maximum value of ΔXi/Xave was 0.11. The maximum values are shown in Table 3.

Another brand-new photoreceptor was installed in the apparatus, and after 60,000 image patterns in FIG. 9 were produced thereby under the same conditions, a solid image and an image pattern in FIG. 9 were produced thereby to visually and with a microscope observe the images to find both of them had high-quality images. The image quality evaluation results are shown in Table 3.

○: High-quality image

Δ: Some parts have low image density when observed with a micro scope (No problem in practical use)

×: Abnormal image

Example 2

The evaluation of the image forming apparatus in Example 1 was repeated except that the protectant bar was replaced with the protectant bar 2 and the spring 23 was replaced with a spring of 4.8 N. The evaluation results are shown in Table 3.

Example 3

The evaluation of the image forming apparatus in Example 1 was repeated except that the protectant bar was replaced with the protectant bar 3A and the spring 23 was replaced with a spring of 7 N. The evaluation results are shown in Table 3.

Example 4

The evaluation of the image forming apparatus in Example 1 was repeated except that the protectant bar was replaced with the protectant bar 3A the spring 23 with a spring of 4.8 N, and the protectant application blade 24*a* with an obtuse urethane blade. The evaluation results are shown in Table 3.

Example 5

The evaluation of the image forming apparatus in Example 1 was repeated except that the protectant bar was replaced with the protectant bar 3A, the spring 23 with a spring of 4.8 N, and the linear speed of the photoreceptor was changed from 125 mm/sec to 190 mm/sec. The evaluation results are shown in Table 3.

Example 6

The evaluation of the image forming apparatus in Example 4 was repeated except that the protectant bar 3A was replaced with the protectant bar 5. The evaluation results are shown in Table 3.

Example 7

The evaluation of the image forming apparatus in Example 6 was repeated except that the linear speed of the photoreceptor was changed from 125 mm/sec to 280 mm/sec. The evaluation results are shown in Table 3.

The final image of Example 6 and that of Example 7 were compared with a microscope to find that the image of Example 7 had a part having image density lower than that of the same part of the image of Example 6. However, no particular difference was seen therebetween when visually observed.

Comparative Example 1

The evaluation of the image forming apparatus in Example 1 was repeated except that the protectant bar was replaced with the protectant bar 1-2, the brush 22*a* with the brush B, the spring 23 with a spring of 4.8 N, and the maximum value of ΔXi/Xave was not determined. The evaluation results are shown in Table 3.

Comparative Example 2

The evaluation of the image forming apparatus in Example 1 was repeated except that the protectant bar was replaced with the protectant bar 1-3, the brush 22*a* with the brush C, the spring 23 with a spring of 6 N, and the maximum value of ΔXi/Xave was not determined. The evaluation results are shown in Table 3.

Comparative Example 3

The evaluation of the image forming apparatus in Example 1 was repeated except that the protectant bar was replaced with the protectant bar 1-4, the spring 23 with a spring of 3 N, and the maximum value of ΔXi/Xave was not determined. The evaluation results are shown in Table 3.

Comparative Example 4

The evaluation of the image forming apparatus in Example 1 was repeated except that the protectant bar was replaced with the protectant bar 1-5, the brush 22*a* with the brush B, and the spring 23 with a spring of 2.7 N. The evaluation results are shown in Table 3.

Comparative Example 5

The evaluation of the image forming apparatus in Example 1 was repeated except that the protectant bar was replaced with the protectant bar 3B, the brush 22*a* with the brush D, and the spring 23 with a spring of 2 N. The evaluation results are shown in Table 3.

Comparative Example 6

The evaluation of the image forming apparatus in Example 1 was repeated except that the protectant bar was replaced with the protectant bar 1-6, the spring 23 with a spring of 8 N, and 500 image patterns in FIG. 9 were produced in an environment of 15° C. and 30% Rh. The evaluation results are shown in Table 3.

Another brand-new photoreceptor was installed in the apparatus, and after25,000 image patterns in FIG. 9 were produced thereby under the same conditions, a solid image, a letter image and an image pattern in FIG. 9 were produced thereby to visually find that some letters were crushed. The evaluation results are shown in Table 3.

Comparative Example 7

The evaluation of the image forming apparatus in Example 1 was repeated except that the protectant bar was replaced with the protectant bar 4,the spring 23 with a spring of 4.5 N, and the maximum value of ΔXi/Xave was not determined. The evaluation results are shown in Table 3.

Comparative Example 8

The evaluation of the image forming apparatus in Comparative Example 7 was repeated except that the linear speed of the photoreceptor was changed from 125 mm/sec to 190 mm/sec and the maximum value of ΔXi/Xave was not determined. The evaluation results are shown in Table 3.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2008-064729 and 2008-256853, filed on Mar. 13, 2008, and Oct. 1, 2008, respectively, the entire contents of which are herein incorporated by reference.

What is claimed is:

1. An image forming apparatus, comprising:

an image bearer configured to have a resin layer comprising a carbonate bond on its surface;

an image former configured to form a toner image on the image bearer;

a transferer configured to transfer the toner image onto a receiving material; and a protectant applicator configured to apply a protectant comprising zinc stearate and zinc palmitate to the surface of the image bearer, wherein the protectant is a protectant bar or a protectant block, that comprises zinc stearate and zinc palmitate and is formed by compression molding methods, wherein an average amount of the protectant adhering to the image bearer is from 0.4 to 2.0 $\mu g/cm^2$ after 500 images are produced, and wherein the following relationships are satisfied:

$$X=Sb/Sa$$

wherein X represents an index of the amount of the protectant adhering at an arbitrary point i on the surface of the image bearer; Sa represents a peak area in a wavenumber domain of from 1,765 to 1,786 $cm^{-1}$ based on a wavenumber domain of from 1,751 to 1,801 $cm^{-1}$ in an infrared absorption spectrum (IR spectrum) measured by attenuated total reflection (ATR) method using a Ge prism as an ATR prism and an IR incidence angle of 45° at the arbitrary point i on the surface of the image bearer; and Sb represents a peak area in a wavenumber domain of from 1,533 to 1,547 $cm^{-1}$ based on a wavenumher domain of from 1,483 to 1,589 $cm^{-1}$ therein, and $$\Delta Xi/Xave<0.3$$

wherein Xi represent the indices X at n-pieces (1 to n) of the arbitrary points i in an image forming area of the image bearer along its longitudinal direction; Xave represents an average of the n-pieces of Xi; and $\Delta Xi|Xi-Xave|$ represents a variation of Xi, and wherein the protectant further comprises boron nitride in zinc stearate in an amount of from 12 to 17% by weight based on total weight of solid contents of protectant.

2. The image forming apparatus of claim 1, wherein the protectant comprises the zinc stearate and the zinc palmitate in an amount not less than 55% by weight.

3. The image forming apparatus of claim 1, wherein the protectant applicator comprises a protection layer former comprising a blade.

4. The image forming apparatus of claim 3, wherein the protection layer former comprises a brush-shaped protectant application member.

5. The image forming apparatus of claim 3, wherein the blade contacts the image bearer in the counter direction of the rotational direction thereof.

6. The image forming apparatus of claim 3, wherein the blade is an obtuse blade.

7. The image forming apparatus of claim 3, further comprising a cleaner configured to clean the image bearer, wherein the blade is independently located from a blade of the cleaner.

8. The image forming apparatus of claim 1, wherein the protectant further comprises alumina.

9. The image forming apparatus of claim 1, further comprising a charger configured to charge the image bearer in contact therewith or close thereto with a DC voltage overlapped with an AC voltage.

10. The image forming apparatus of claim 1, wherein the image bearer rotates at a linear speed not less than 180 mm/sec.

11. The image forming apparatus of claim 1, wherein the protectant applicator comprises:

a protectant bar;

a bar holding guide configured to hold the protectant bar;

a protectant application member comprising a brush contacting the protectant bar, configured to apply the protectant transferred onto the brush to the image bearer;

a pressure applicator configured to press the protectant bar to the brush to transfer the protectant to the brush; and a protection layer former configured to form a thin layer of the protectant on the image bearer with a blade.

12. A process cartridge installed in the image forming apparatus according to claim 1, wherein the process cartridge comprises the image bearer and the protectant applicator.

13. The image forming apparatus of claim 1, further comprising a cleaner member to clean the image bearer, wherein the protectant applicator includes a protectant application blade to apply the protectant to the surface of the image bearer, wherein the image bearer rotates in a rotational direction while the protectant application blade applies the protectant, and wherein each of the cleaner member and the protectant application blade contacts the image bearer in a counter direction against the rotational direction of the image bearer.

14. The image forming apparatus of claim 1, wherein the protectant applicator includes a protectant application member that is configured to transfer the protectant from the protectant bar or protectant block onto the surface of the image bearer.

* * * * *